US006351733B1

(12) United States Patent
Saunders et al.

(10) Patent No.: US 6,351,733 B1
(45) Date of Patent: Feb. 26, 2002

(54) METHOD AND APPARATUS FOR ACCOMMODATING PRIMARY CONTENT AUDIO AND SECONDARY CONTENT REMAINING AUDIO CAPABILITY IN THE DIGITAL AUDIO PRODUCTION PROCESS

(75) Inventors: William R. Saunders; Michael A. Vaudrey, both of Blacksburg, VA (US)

(73) Assignee: Hearing Enhancement Company, LLC, Roanoke, VA (US)

( * ) Notice: Subject to any disclaimer, the term of this patent is extended or adjusted under 35 U.S.C. 154(b) by 0 days.

(21) Appl. No.: 09/580,205

(22) Filed: May 26, 2000

Related U.S. Application Data

(60) Provisional application No. 60/186,357, filed on Mar. 2, 2000.

(51) Int. Cl.[7] ..... G10L 19/00

(52) U.S. Cl. ..... 704/500; 704/278; 704/225; 434/308; 362/82

(58) Field of Search ..... 704/500, 501, 704/212, 278, 270, 225; 434/308, 319; 360/22, 24; 381/10

(56) References Cited

U.S. PATENT DOCUMENTS

| | | | |
|---|---|---|---|
| 2,783,677 | A | 3/1957 | Becker |
| 3,046,337 | A | 7/1962 | Hornyak |
| 3,110,769 | A | 11/1963 | Bertram |
| 4,024,344 | A | 5/1977 | Dolby et al. |
| 4,051,331 | A | 9/1977 | Strong et al. |
| 4,052,559 | A | 10/1977 | Paul et al. |
| 4,074,084 | A | 2/1978 | van den Berg |
| 4,150,253 | A | 4/1979 | Knoppel |
| 4,405,831 | A | 9/1983 | Michelson |
| 4,406,001 | A | 9/1983 | Klasco et al. |
| 4,454,609 | A | 6/1984 | Kates |
| 4,484,345 | A | 11/1984 | Stearns |

(List continued on next page.)

FOREIGN PATENT DOCUMENTS

| | | |
|---|---|---|
| JP | 5342762 | 12/1993 |
| WO | WO 97/37449 | 10/1997 |

OTHER PUBLICATIONS

ATSC Digital Television Standard, ATSC, Sep. 16, 1995, Annex B. Available on–line at www.atsc.org/Standards/A53/.

(List continued on next page.)

*Primary Examiner*—Richemond Dorvil
*Assistant Examiner*—Daniel Abebe
(74) *Attorney, Agent, or Firm*—Kenyon & Kenyon

(57) ABSTRACT

The invention enables the inclusion of voice and remaining audio information at different parts of the audio production process. In particular, the invention embodies special techniques for VRA-capable digital mastering and accommodation of VRA by those classes of audio compression formats that sustain less losses of audio data as compared to any codecs that sustain comparable net losses equal or greater than the AC3 compression format. The invention facilitates an end-listener's voice-to-remaining audio (VRA) adjustment upon the playback of digital audio media formats by focusing on new configurations of multiple parts of the entire digital audio system, thereby enabling a new technique intended to benefit audio end-users (end-listeners) who wish to control the ratio of the primary vocal/dialog content of an audio program relative to the remaining portion of the audio content in that program.

24 Claims, 13 Drawing Sheets

U.S. PATENT DOCUMENTS

| | | | | | |
|---|---|---|---|---|---|
| 4,516,257 | A | | 5/1985 | Torick | |
| 4,622,440 | A | | 11/1986 | Slavin | |
| 4,776,016 | A | | 10/1988 | Hansen | |
| 4,809,337 | A | | 2/1989 | Scholz et al. | |
| 4,816,905 | A | | 3/1989 | Tweedy et al. | |
| 4,868,881 | A | | 9/1989 | Zwicker et al. | |
| 4,890,170 | A | | 12/1989 | Inohana et al. | |
| 4,941,179 | A | | 7/1990 | Bergenstoff et al. | |
| 5,003,605 | A | | 3/1991 | Phillipps et al. | |
| 5,033,036 | A | | 7/1991 | Ohmori et al. | |
| 5,131,311 | A | | 7/1992 | Murakami et al. | |
| 5,138,498 | A | | 8/1992 | Takigami | |
| 5,144,454 | A | | 9/1992 | Cury | |
| 5,146,504 | A | | 9/1992 | Pinckley | |
| 5,155,510 | A | | 10/1992 | Beard | |
| 5,155,770 | A | | 10/1992 | Maejima | |
| 5,197,100 | A | * | 3/1993 | Shiraki | 381/27 |
| 5,210,366 | A | | 5/1993 | Sykes, Jr. | |
| 5,212,764 | A | | 5/1993 | Ariyoshi | |
| 5,216,718 | A | | 6/1993 | Fukuda | |
| 5,228,088 | A | | 7/1993 | Kane et al. | |
| 5,294,746 | A | | 3/1994 | Tsumura et al. | |
| 5,297,209 | A | | 3/1994 | Kowaki | |
| 5,319,713 | A | | 6/1994 | Waller, Jr. et al. | |
| 5,323,467 | A | | 6/1994 | Hermes | |
| 5,341,253 | A | | 8/1994 | Liao et al. | |
| 5,384,599 | A | | 1/1995 | Casavant et al. | |
| 5,395,123 | A | | 3/1995 | Kondo | |
| 5,396,560 | A | | 3/1995 | Arcos et al. | |
| 5,400,409 | A | | 3/1995 | Linhard | |
| 5,408,686 | A | | 4/1995 | Mankovitz | |
| 5,434,922 | A | | 7/1995 | Miller et al. | |
| 5,450,146 | A | | 9/1995 | Chedeville et al. | |
| 5,466,883 | A | | 11/1995 | Miyashita et al. | |
| 5,469,370 | A | | 11/1995 | Ostrover et al. | |
| 5,485,522 | A | | 1/1996 | Solve et al. | |
| 5,530,760 | A | | 6/1996 | Paisley | |
| 5,541,999 | A | | 7/1996 | Hirai | |
| 5,564,001 | A | | 10/1996 | Lewis | |
| 5,569,038 | A | | 10/1996 | Tubman et al. | |
| 5,569,869 | A | | 10/1996 | Sone | |
| 5,572,591 | A | | 11/1996 | Numazu et al. | |
| 5,576,843 | A | | 11/1996 | Cookson et al. | |
| 5,619,383 | A | | 4/1997 | Ngai | |
| 5,621,182 | A | | 4/1997 | Matsumoto | |
| 5,621,850 | A | | 4/1997 | Kane et al. | |
| 5,631,712 | A | | 5/1997 | Suh et al. | |
| 5,644,677 | A | | 7/1997 | Park et al. | |
| 5,666,350 | A | | 9/1997 | Huang et al. | |
| 5,668,339 | A | * | 9/1997 | Shin | 84/634 |
| 5,671,320 | A | | 9/1997 | Cookson et al. | |
| 5,684,714 | A | | 11/1997 | Yogeshwar et al. | |
| 5,698,804 | A | | 12/1997 | Mizuno | |
| 5,703,308 | A | | 12/1997 | Tashiro et al. | |
| 5,706,145 | A | | 1/1998 | Hindman et al. | |
| 5,712,950 | A | | 1/1998 | Cookson et al. | |
| 5,717,763 | A | | 2/1998 | Choi et al. | |
| 5,732,390 | A | | 3/1998 | Katayanagi et al. | |
| 5,751,903 | A | | 5/1998 | Swaminathan et al. | |
| 5,808,569 | A | | 9/1998 | Wuppermann et al. | |
| 5,809,472 | A | * | 9/1998 | Morrison | 704/500 |
| 5,812,688 | A | | 9/1998 | Gibson | |
| 5,820,384 | A | | 10/1998 | Tubman et al. | |
| 5,822,370 | A | | 10/1998 | Graupe | |
| 5,852,800 | A | | 12/1998 | Modeste et al. | |
| 5,872,851 | A | | 2/1999 | Petroff | |
| 5,902,115 | A | * | 5/1999 | Katayama | 434/307 A |
| 5,991,313 | A | | 11/1999 | Tanaka et al. | |

OTHER PUBLICATIONS

Guide to the Use of ATSC Digital Television Standard, ATSC, Oct. 4, 1995, pp. 54–59. Available on–line at www.atsc.org/Standards/A54/.

Digital Audio Compression Standard (AC–3), ATSC, Annex C "AC–3 Karaoke Mode", pp. 127–133. Available on–line at www.atsc.org/Standards/A52/.

Shure Incorporated homepage, available on–line at www-.shure.com. The Examiner is encouraged to review the entire website for any relevant subject matter.

Digidesign's web page listing of their Aphex Aural Exciter. Available on–line at www.digidesign.com/products/all_prods.php3?location=main&product_id=8. The Examiner is encouraged to review the entire website for any relevant subject matter.

* cited by examiner

PREMIXED 2-CHANNEL VRA-CAPABLE DIGITAL MASTER

PREMIXED 1-CHANNEL VRA-CAPABLE DIGITAL MASTER

POST-MIXED 2-CHANNEL VRA-CAPABLE DIGITAL MASTER

POST-MIX 1-CHANNEL VRA-CAPABLE MASTER

VRA-CAPABLE ENCODER: EMBODIMENT 1

VRA-CAPABLE ENCODER: EMBODIMENT 2

METHOD AND APPARATUS FOR ACCOMMODATING PRIMARY CONTENT AUDIO AND SECONDARY CONTENT REMAINING AUDIO CAPABILITY IN THE DIGITAL AUDIO PRODUCTION PROCESS

This application claims benefit to Provisional Application No. 60/186,357, entitled "Techniques for Accommodating Primary Content (Pure Voice) Audio and Secondary Content Remaining Audio Capability in the Digital Audio Production Process", filed on Mar. 2, 2000, which is incorporated herein by reference in its entirety.

FIELD OF THE INVENTION

The invention relates to the audio signal processing, and more particularly, to the enhancement of a desired portion of the audio signal for individual listeners.

BACKGROUND OF THE INVENTION

Recent widespread incorporation of digital audio file archiving, compression, encoding, transmission, decoding, and playback has led to the possibility of new opportunities at virtually every stage of the digital audio process. It was recently shown that the preferred ratio of voice-to-remaining audio (VRA) differs significantly for different people and differs for different types of media programs (sports programs versus music, etc.). See, "A Study of Listener Preferences Using Pre-Recorded Voice-to-Remaining Audio," Blum et al., HEC Technical Report No. 1, January 2000.

Specifically, VRA refers to the personalized adjustment of an audio program's voice-to-remaining audio ratio by separately adjusting the vocal (speech) volume independently of the separate adjustment of the remaining audio volume. The independently user-adjusted voice audio information is then combined with the independently user-adjusted remaining audio information and sent to a playback device where a further total volume adjustment may be applied. This technique was motivated by the discovery that each individual's hearing capabilities are as distinctly different as their vision capabilities, thereby leading to individual preferences with which they wish (or even need) to hear the vocal versus background content of an audio program. The conclusion is that the need for VRA capability in audio programs is as fundamental as the need for a broad range of prescription lenses in order to provide optimal vision characteristics to each and every person.

SUMMARY OF THE INVENTION

The invention enables the inclusion of voice and remaining audio information at different parts of the audio production process. In particular, the invention embodies special techniques for VRA-capable digital mastering and accommodation of VRA by those classes of audio compression formats that sustain less losses of audio data as compared to any codecs that sustain comparable net losses equal or greater than the AC3 compression format.

The invention facilitates an end-listener's voice-to-remaining audio (VRA) adjustment upon the playback of digital audio media formats by focusing on new configurations of multiple parts of the entire digital audio system, thereby enabling a new technique intended to benefit audio end-users (end-listeners) who wish to control the ratio of the primary vocal/dialog content of an audio program relative to the remaining portion of the audio content in that program. The problems that motivate the specific invention described herein are twofold. First, it is recognized that there will be differing opinions on the best location in the audio program production path for construction of the two signals that enable VRA adjustments. Second, there are tradeoffs between the optimal audio compression formats, audio file storage requirements, audio broadcast transmission bit rates, audio streaming bit rates, and the perceived listening quality of both vocal and remaining audio content finally delivered to the end-listener. Various solutions to those two problems, for the ultimate purpose of providing VRA to the end-listener, are offered by this invention through new embodiments that may incorporate new or existing digital mastering, audio compression, encoding, file storage, transmission, and decoding techniques.

In addition, the invention may adaptive to the various ways that an audio program may be produced so that the so-called pure voice audio content and the remaining audio content is readily fabricated for storage and/or transmission. In this manner, the recording process is considered to be an integral component of the audio production process. The new audio content may be delivered to the end-listener in a transparent manner, irrespective of specific audio compression algorithms that may be used in the digital storage and/or transmission of the audio signal. This will require the inclusion of the voice and remaining audio information in virtually any CODEC. Therefore, this invention defines a unique digital mastering process and uncompressed storage format that will be compatible with lossless and minimally lossy compression algorithms used in many situations.

The embodiments of the invention may also focus on required features for VRA encoding and VRA decoding. Because of the commonality among audio codecs, all descriptions provided below can be considered to provide VRA functionality equally well for broadcast media (such as television or webcasting), streaming audio, CD audio, or DVD audio. The invention may also be intended for all forms of audio programs, including films, documentaries, videos, music, and sporting events.

With these and other advantages and features of the invention that will become hereinafter apparent, the nature of the invention may be more clearly understood by reference to the following detailed description of the invention, the appended claims and to the several drawings attached herein.

BRIEF DESCRIPTION OF THE DRAWINGS

The invention is described below with reference to the following drawings, wherein.

DESCRIPTION OF THE PREFERRED EMBODIMENTS

Figure 1:
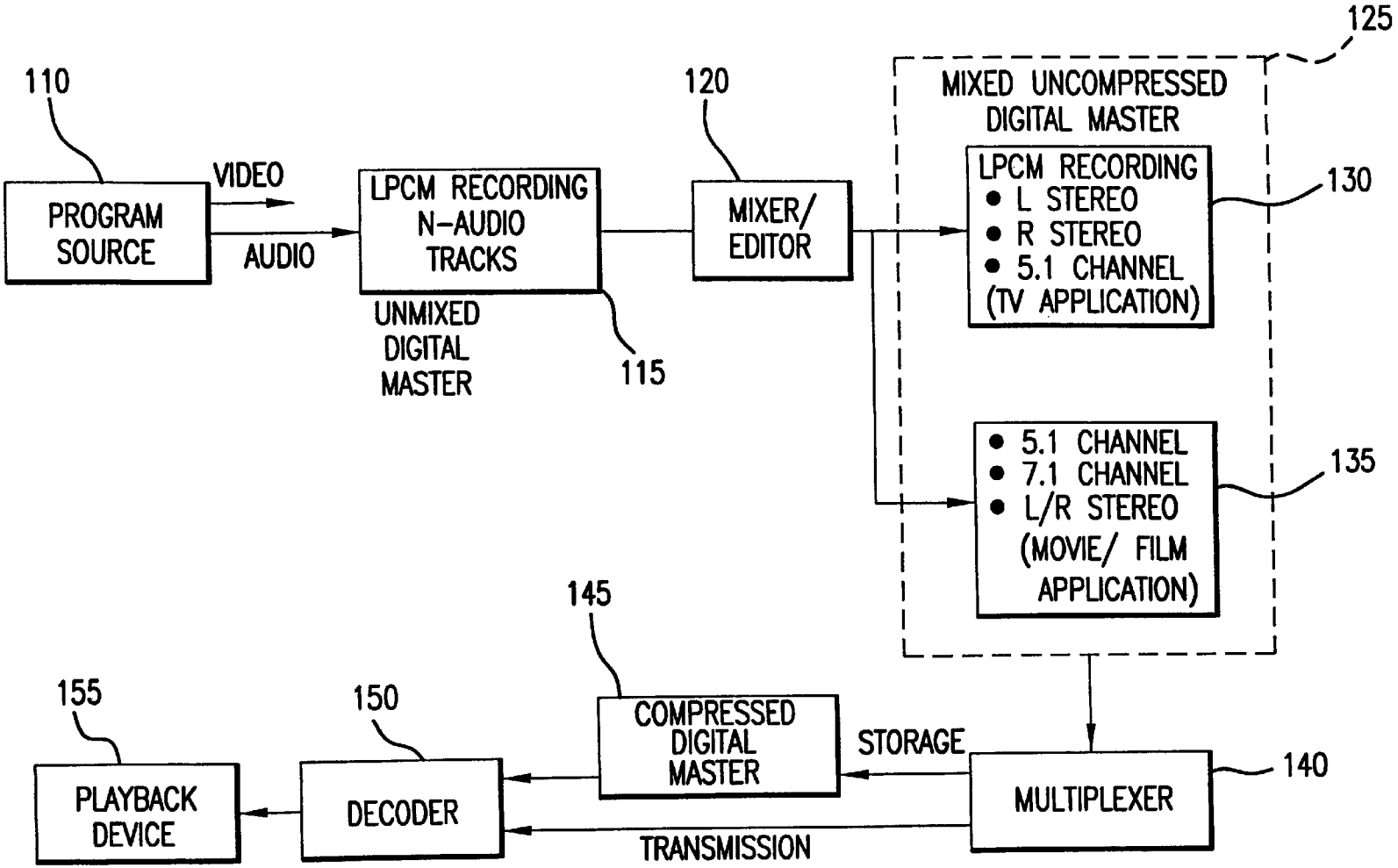
FIG. 1 is a diagram illustrating a conventional digital mastering structure.

A VRA adjustment may be used as a remedy for various forms of hearing impairments. Audiology experts will quickly point out that the optimum solution for nearly all forms of hearing impairments is to allow the hearing impaired listener to receive the aural signal of interest (usually voice) without 'contamination' of background sounds. Therefore, the VRA feature can be expected to enhance the lives of hearing impaired individuals. Recent investigations, however, have identified a significant variance in the optimal mix of a preferred signal (a sports announcer's voice, for example) and a remaining audio signal (background noise of the crowd, for example) in virtually all segments of the population. Proof of this need for 'diversity in listening' to audio information is consistent with the overall diversity of the millions of human beings over the entire earth.

This discovery comes at a time when the advent of digital audio has made it possible to send large amounts of high quality audio information, as well as audio control information (or metadata), to the listener. Unfortunately, the incorporation of VRA features in digital audio has not been provided in any media form to date. Work in this area has been limited to the mention of a so-called 'Hearing Impaired Associated Service' that is configured as an optional part of the ATSC AC3 digital audio standard. See, "A-54: A Guide to the Use of the AC3," ATSC report, 1995, which contains a short paragraph that describes how a hearing impaired user might wish to receive a specially prepared signal of vocal content only, as part of the AC3 bitstream, and to blend that vocal content, with adjusted volume, with the other audio channels (main audio service) normally transmitted as part of the ATSC-specified bitstream. It is well-known that the AC3 audio format mentioned in the A-54 document is based on a Dolby Labs compression algorithm referred to by digital audio experts as a 'perceptual coding' compression format. The perceptual coding algorithms are designed to discard some percentage of the original audio signal content in order to reduce the storage size requirements of archived files and to reduce the amount of information that must be transmitted in a real-time broadcast such as HDTV. The discarded audio data is supposed to go unnoticed by the listener because the algorithm attempts to eliminate only those data that the ear could not hear anyway. Unfortunately, perceptual coding algorithms have been subject to long-standing debate about the ultimate listening quality that is retained after certain audio content has been discarded.

One of the fundamental reasons for providing VRA capabilities in any audio program is to enhance the understanding and listening pleasure for end-users who are currently forced to try to understand or enjoy the provided mix-down ratios of voice and remaining audio. When pure voice is offered using very lossy compression algorithms, such as AC3, the voice quality is necessarily reduced. The AC3 perceptual coding algorithm is associated with compression ratios of approximately 12:1, which means that the original audio content has retained only 1 bit for every 12 original bits of information. This means that the primary purpose for inclusion of VRA features is arguably defeated by the extent of perceptible loss in audio quality that is associated with such lossy compression algorithms.

Therefore, there is an overwhelming need for VRA inclusion techniques in all lossless, or relatively lossless, digital audio codecs so that the end-user can be the one to make the final decision about the voice quality they are willing to accept in the VRA adjustment.

Before a discussion of embodiments that will ensure transparent delivery of VRA capability to the consumer (as end-listener) in any digital audio setting, it will be helpful to discuss the framework whereby the new 'pure voice' content can be made accessible by content providers in a standardized manner. A transparent delivery refers to the act of providing end-listeners with VRA capability, regardless of the specific audio format (e.g. MP3, DTS, Real Audio, etc.) that is used to store/transmit the audio program to the end-listeners' playback devices.

This framework seeks to ensure that the process takes place with minimal loss of artistic merit by all parties who originate the audio program. This may include actors, musicians, sports broadcasters, directors, and producers of the audio content in films, music recordings, sports programs, radio programs and others. To provide an enabling framework, it will be helpful to introduce new terminology that further clarifies and supports the previously discussed voice-to-remaining audio description.

The new terminology, used in the remainder of this document, is not intended to refute or negate the previous designations of "pure voice" and "remaining audio". Instead, the new designations are being introduced in order to facilitate the framework whereby producers of various audio programs can identify these signals appropriately for encoding, compression and decoding processes. Additionally, this discussion clarifies several possibilities that producers or secondary content providers may use to fabricate the "pure voice" signals and the "remaining audio signals".

One of the embodiments of the pure voice/remaining audio content is defined to include the "primary-content pure voice audio" and the "secondary content remaining audio" content. The reason for these two labels is related to the intended use of the VRA function for the end-listener, as well as the desire for the originators of the audio program to retain some artistic freedom in creating the two signals that will be mixed by the end listener upon playback. First, consider the end-listeners' intended uses of the VRA function. They wish to be able to adjust the essential part of the audio program so that they enjoy the program better or understand the program better. In some cases, the adjustment will be obvious. For example, the sports announcer's voice, or the referee's announcements, is very arguably the essential information in a sports program's audio content. The background, or remaining audio, is the crowd noise that is also present in the audio content. Some listeners may wish to adjust the crowd noise to higher levels in order to feel more involved in the game, while others may be annoyed by the crowd noise. Therefore, it seems straightforward to state that the primary-content pure voice audio information is identical to the announcers' or referee's voices and the secondary-content remaining audio signal is the crowd noise.

A distinction between primary-content pure voice and secondary-content remaining audio is not as easy to make for numerous other situations. Taking a film soundtrack as an example, there may be times in the film where there are several people talking at once. Sometimes when this happens, the viewer may be able to move through that scene with complete understanding and appreciation of the plot even if he/she hears only one of the voices. There will likely be other scenes when it is imperative to hear all of the voices at once in order to retain the essence of the film's plot. In the latter case, the blend of all voices would have to be deemed the primary content pure voice content in order for the viewer to appreciate the entire art of the film in that scene. Therefore, there will be a large degree of artistic license retained by those who produce the audio program as they decide what part of the program is to be provided to the listener for the ultimate VRA adjustment.

It is even possible that the primary content pure voice signal may be constructed with non-vocal audio sounds if the producer/artist feels that the non-vocal audio is essential at that point in the program. For example, the sound of an alarm going off may be essential to the viewer understanding why the actor/actress is leaving an area very suddenly. Therefore, the primary content pure voice signal is not to be construed as strictly voice information at all instants in an audio program but it is understood that this signal may also contain brief segments of other sounds.

This motivates a third definition that will be referred to as the "primary content audio (PCA)" information. This is important for purposes of transmission, as well. It is well known by those versed in the art that it is possible to compress speech-only audio content using more efficient compression algorithms than are used for general audio. This is related to the reduced bandwidth of speech-only audio. content. Therefore, it will be important to the efficiency and quality of the encoding process that the producers define whether the signal is 'primary content pure voice (PCPV/PCA)' or 'primary content audio (PCA)'. This could even be provided to the encoder as a parameter that changes as the audio program evolves, allowing speech-only encoding when the signal is defined to be PCPV/PCA and switching to a more general encoder algorithm during those instants when the program is flagged as PCA.

Another important feature of the PCPV/PCA/SCRA signal fabrications is the potential need for spatial information in any or all of those signals at various points in the program. There will almost certainly be scenes where it is essential that the listener hear information coming from a surround location, versus the normally centered vocal content in films. If that capability is not provided, the program loses some artistic merit and possibly appreciation of the plot. Inclusion of any essential spatial information can be accommodated by multi-channel playback of the signals. Therefore, this invention also seeks to describe methods that also enable those situations where there is a need for storage, compression, and decoding of multiple channels of primary content pure voice.

The development of digital audio technologies over the past fifteen years has led to numerous methods in the production, encoding, and decoding processes that underlie "digital sound". It is most important to point out that creation, storage, processing, delivery, and playback of multiple channels of digital audio signals has been practiced for many years now. In fact, the recent trend in digital audio is towards ever-increasing numbers of audio channels that can be delivered to a playback device. For example, one of the major new features woven into the most recent MPEG-4 digital audio standard (ISO ###) was the capability to accommodate up to 64 channels of digital audio in the encoding, bitstreaming, and decoding processes.

This push towards higher numbers of digital audio channels are not presupposed by this issue. A very important distinguishing feature of the embodiments is the recognition that a wide variety of listeners will want (non-hearing impaired listeners) or need (hearing impaired listeners) to be provided with the new VRA adjustment. Therefore, this recognition leads to a need for descriptions of how the formats of digital masters be compatible with new encoding techniques that have been programmed to maintain the integrity of the PCPV/PCA and SCRA signals throughout the entire digital audio production process.

Maintaining this integrity is essential to ensure that the listener will ultimately by able to adjust only two signals—the voice and remaining audio—upon playback. This act of constructing the PCPV/PCA/SCRA signals may possibly be viewed as mixing at some level. However, the invention facilitates maintaining a PCPV/PCA signal throughout the production process and thereby gives a listener the ability to understand the dialogue information from that signal alone.

The other equally important observation is that the precise the enabling technologies required to get the PCPV/PCA/SCRA signals all the way through the digital audio production process do not presently exist. Therefore, some of the most important embodiments discussed below are associated with the method of maintaining the integrity of those signals. This will be accomplished by the use of special header data and auxiliary data channel(s) that: i) "inform" any encoder that the incoming signal has PCPV/PCA/SCRA information (i.e. is VRA-capable); ii) instruct the encoder how to develop the bitstream such that the PCPV/PCA/SCRA content is delivered from the VRA-capable digital master tape/file to the decoder in a known manner; iii) and provide information to the decoder about how construct, reconstruct, and/or playback the PCPV/PCA/SCRA signals at the playback device.

Prior to describing the embodiments of the invention, it may also be helpful to clarify the original intent of the VRA adjustment using the newly described terminology provided above. Recall that one of the solutions offered by this invention is to create two unique audio signals, referred to as either pure voice and remaining audio or PCPV/PCA/SCRA, and facilitate delivery to an end-listener who may independently adjust the volume of each signal. Therefore, this invention seeks to define new production processes whereby the end-listener ultimately is given access to the volume adjustments of only those two signals.

From the preceding examples, it is clear that there will be times when the PCPV/PCA signals are constructed by mixing together audio content from multiple channels (primarily, if not exclusively, voice content audio) of recorded information. However, it is very important for the reader to appreciate that the end-result is the creation of only two individual signals—the PCPV/PCA signal and the SCRA signal. As the embodiments shown later in this document illustrate, there are various locations in the production path where those two signals may be finally constructed for the end-listener. For example, the producer may wish to combine them during the recording process so that they are on the first mastering tape.

Another method may be to record numerous voice tracks from different singers/actors on the program and then combine them to create a PCPV/PCA signal during a post-recording mixing session. Another possibility might be to create a digital tape with a large number of channels and then send along a data channel that instructs the decoder how to downmix any certain blend of those channels in order to create the single PCPV/PCA or SCRA signals at any instant during playback of the program. But the end-result of all these inventive methods is that the end-listener is given only two signals that enable the VRA adjustment.

So, it is very apparent that there is a need for the PCPV/PCA/SCRA signals to be dealt with in a particular manner by audio program sound engineers. At this time, there are no industry-defined methods built into digital mastering, encoding algorithms, or decoding algorithms, that will specifically enable the transparent delivery of the primary content (pure voice) audio and secondary content remaining audio simultaneously, yet completely separately, to the end-user for VRA adjustment. The following embodiments describe methods that have been developed in order to make sure that the content providers, secondary providers, and end-listeners can take full-advantage of VRA adjustment for a multitude of audio codecs that are utilized at any stage between recording and speaker playback. Numerous archiving forms that enable the VRA process are also described in detail below.

A description of the exemplary embodiments that enable an ultimate VRA adjustment by the end-listener is given below. In order to better appreciate these embodiments, the first step will be to clarify the existing state of digital audio delivery to illustrate the obvious omission of PCPV/PCA/SCRA signals at the eventual playback device, no matter whether for televisions, VCR players, DVD players, CD players or any other audio playback device. Schematically, this is shown in FIG. 1. The figure depicts the typical audio production process beginning with the program source 110 components that should make up the audio program. The various elements are then recorded, typically on a DAT recorder 115, using a linear, uncompressed audio format. This will be called the uncompressed, unmixed, digital master.

Next, at some time, there is a mixer/editor 120 the performs the mixing and editing process in order to create the audio channels that are to be delivered to the television viewer 130 or the movie viewer 135 or numerous other audio applications. For example, that audio content will consist of left and right stereo channels, or so-called 5.1 channels including L, R, C, LS, and RS, or 7.1 channels which adds two additional surround speakers. Recent standards such as MPEG4 have provided for the capability of even higher numbers of audio channels but there are no other applications greater than 7.1 in widespread practice at this time. The format of 130 and 135 will be called the mixed, uncompressed digital master 125.

The next step is to play the uncompressed audio into an audio codec 150 where the audio will likely go through some amount of compression and then bitstream syntaxing. At this point, it will be possible to construct a compressed, mixed, digital master 145. The production process will most typically make copies of the compressed, mixed, digital master 145 and distribute that version of copies versus the other two master tape versions illustrated in the figure. The playback device 155 then plays back the stereo, 5.1, 7.1 channels, etc. depending on the decoder 150 settings.

For the understanding the embodiments of this invention presented below, it is important to notice that current practice does not provide means for the storage or creation of the PCPV/PCA/SCRA signals using any of the digital mastering tape configurations. Therefore, the following section of embodiments presents various methods to construct digital masters that accommodate production of those signals for ultimate VRA purposes.

VRA-Capable Digital Mastering Embodiments

Figure 2A:
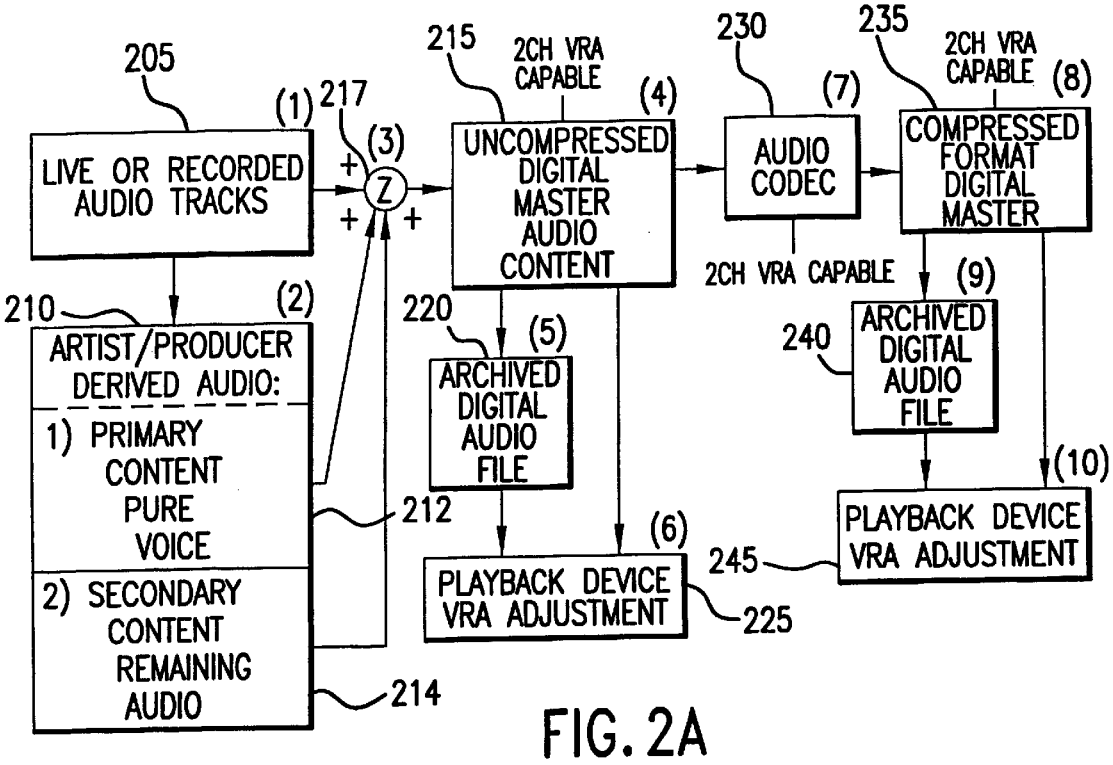
FIG. 2A is a diagram illustrating a pre-mix embodiment for two channel VRA-capable digital master audio tapes.
Figure 2B:
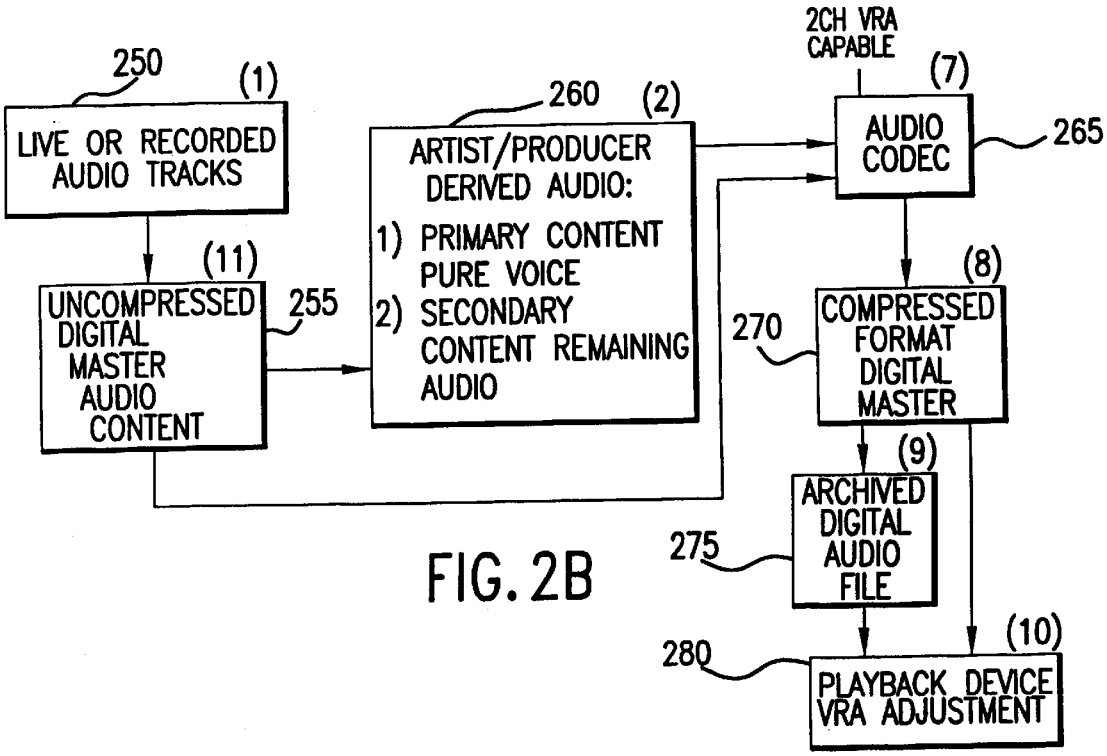
FIG. 2B is a diagram illustrating a post-mix embodiment for two channel VRA-capable digital master audio tapes.

The enabling steps required for creating different versions of VRA-capable digital master tapes or files of an audio program are shown in FIGS. 2A and 2B. "VRA-capable" refers to a digital master tape or file that includes the PCPV/PCA and SCRA signals explicitly or includes sufficient 'VRA auxiliary data' such that one or both of those signals may be constructed at the decoder level by using the auxiliary data and other audio data copied from the digital master. Referring to FIG. 2A, note that all audio programs, whether they are musical, film, television programs, movies, or others, utilize microphones to transduce audio information of all types into real-time electrical signals (denoted as 'live' in FIG. 2A) that are sent to speakers or stored as tracks of either analog or DAT recorders 205. That audio information can also be used, according to the plans of the artists and/or producers of the program 210, to derive the primary content audio signal (PCPV/PCA) 212 and the secondary content remaining audio signal (SCRA) 214.

The "derived audio" label implies an artistic process, as opposed to a hardware component, and may utilize one, two, or more of the audio tracks 205. In FIG. 2A, these two signals are then recombined with all of the separately available tracks from all audio sources (including those used to derive the PCPV/PCA and SCRA signals) at the input node 217 to a DAT recorder in order to create a two-channel, unmixed, uncompressed, VRA-capable digital master for the audio program 215. Note that input node 217 does not literally sum the signals together but simply combines them on the single digital master tape 215. The digital master 215 is preferably constructed using an uncompressed or relatively lossless compressed digital audio format, such as a linear PCM format or optimal PCM format, but not limited to those particular formats, in order to retain the quality of the original audio signals. (Linear PCM format is a well-known, uncompressed audio format used for digital audio files.)

An integral part of the digital mastering for VRA purposes is the creation of special 'header' information that identifies the master tape as VRA-capable and special auxiliary data that defines certain details about the recording process, the types of channels included, labels for each channel, spatial playback instructions for the two signals, and other essential information required by the audio codec 230 and/or the decoder in the playback devices 225 and 245. The header information, and the VRA auxiliary data, are contributing features of this embodiment. The phrase 'audio codec' refers to the encoding process where compression of the digital information occurs, some method of transmission is implied via a bitstreaming process to a decoder (usually MPEG-based ISO standards), and final decoding changes the compressed signal back into analog form for playback to audio speakers. For certain embodiments, it is possible that the VRA-header and auxiliary data information could be provided as a separate bitstream introduced at the compression encoding level, as opposed to creation and storage on the digital master. Embodiments of the auxiliary data, and header information, will be discussed in much greater detail in the following section.

Once the uncompressed version of the VRA-capable digital master in FIG. 2A is complete, the master tape's digital information can be copied for distribution as an uncompressed audio file format 220 before playback on a VRA-capable player 225 that can decode the uncompressed digitally formatted PCPV/PCA/SCRA signals for that audio program. For example, conventional CD audio uses uncompressed, linear PCM data files for playback. This may require that CD players be equipped to recognize whether the audio information is VRA-capable or not and be equipped to accommodate the PCPV/PCA/SCRA signals.

As a second alternative, the digital master file content can be compressed using any number of audio codecs 230 that are used to minimize throughput rates and storage requirements. It is important to note that the output of the audio codec's encoder function might be used in an intermediate step where the compressed version of the audio file 235 is archived 240, as shown in FIG. 2A or reproduced in multiple copies. Again, for clarity, we note that current implementations of such compressed archived files from non-VRA-capable digital masters correspond to well-known media forms such as superCD or DVD audio.

Archived versions of the compressed VRA-capable digital master might also reside on CD media or DVD audio media. However, the inclusion of the PCPV/PCA and/or SCRA channels on archived versions of VRA-capable digital masters necessitates the features described in this invention in order to ensure proper playback of the voice and remaining audio signals. Specifically, the compressed, VRA-capable, archived file 240 can be made accessible to a specific VRA-capable playback device 245 that decodes the PCPV/PCA/SCRA audio signals and facilitates the VRA adjustment.

A second alternative, after compression by the encoding process of the codec, is for the information to be transmitted along a variety of broadcast means directly to a playback device configured to decode the VRA-capable digital audio information according to the specific compression algorithm used by the codec. For example, the transmission may be an ISDN transmission to a PC modem where the compatible VRA-aware decoder will receive the audio information and facilitate VRA adjustments.

FIG. 2B is a slightly different embodiment of the audio process required for VRA capability. The difference in this configuration is that the digital master 255 does not yet contain the PCPV/PCA or SCRA signals 260. Instead, the digital master 255 can consist of 'n' recorded, unaltered audio tracks in the same way that is conventional at this time in the recording industry. The artist-producer derived PCPV/PCA and SCRA signals 260 are then created downstream of the ordinary (i.e. non VRA-capable) digital master 255 through a mixing process defined by the artistic merit and content of the audio program.

Implementation of the mixing for these signals will be implemented using a VRA-capable encoding process discussed in the following section. At that point, the unaltered tracks from the digital master 255 and the PCPV/PCA/SCRA signals 260 are encoded by the VRA-capable audio codec 265 and the playback device 280 will have access to these signals in the same way discussed for the FIG. 2A embodiment. For this embodiment, an uncompressed version of the VRA-capable digital master never exists. This approach might be preferred if the producer of the audio program wishes to pass along to a secondary provider the additional task of specifying and mixing the unique PCPV/PCA/SCRA signals.

Figure 3:
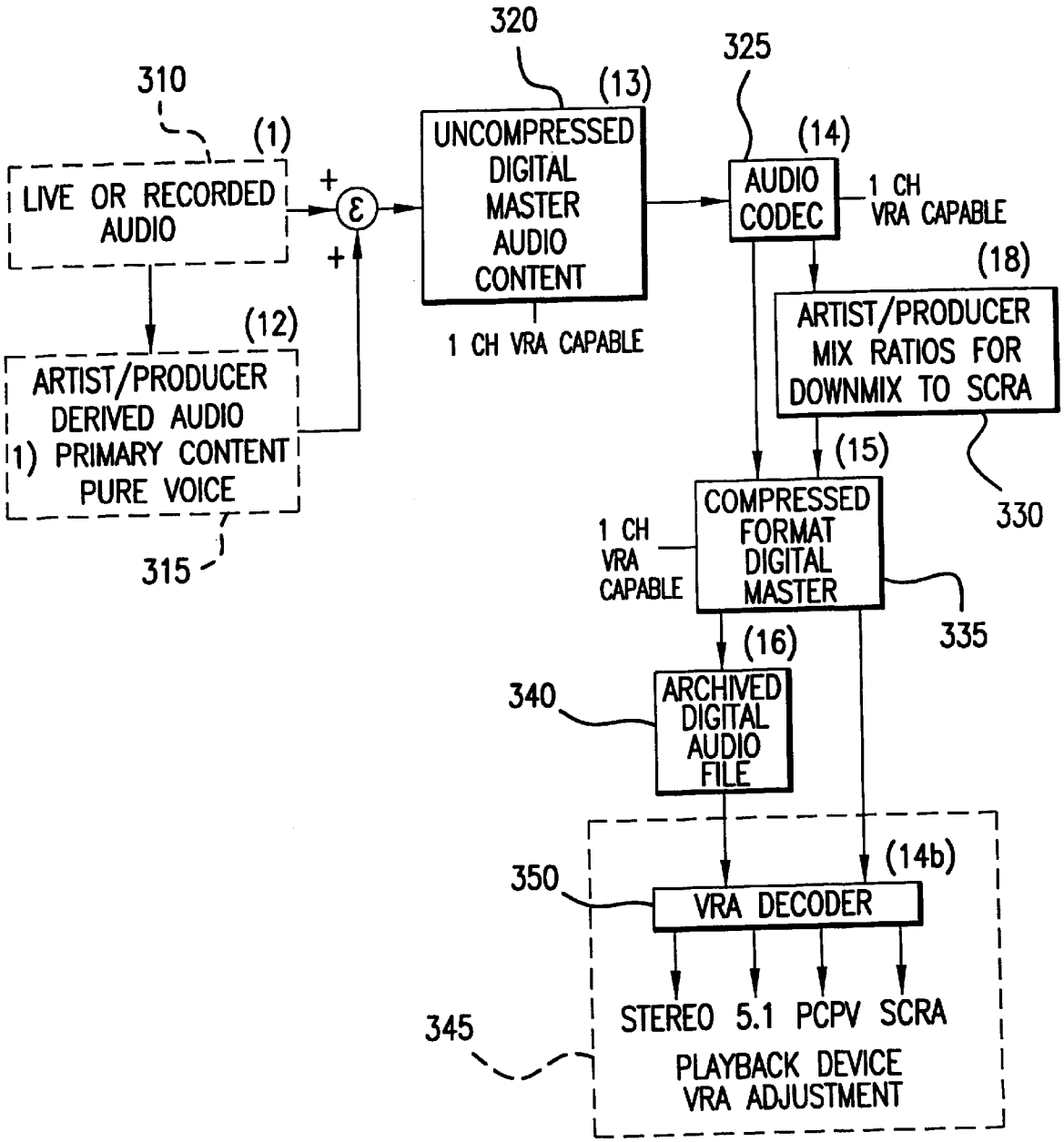
FIG. 3 is a diagram illustrating a pre-mix embodiment for one channel VRA-capable digital master audio tapes with SCRA down-mix parameters.

A third possible embodiment is motivated by the knowledge that it may be preferable to specify the contents of the SCRA signal as some combination of the non-PCPV/PCA channels that will be stored on the digital master. This is illustrated in FIG. 3. For this case, the PCPV/PCA signal only is created prior to creation of the uncompressed digital master and it is stored on the master along with the other audio information. For this embodiment, special VRA-auxiliary information (data) will also be included digitally on the master where that information specifies how to construct the SCRA channel from certain combinations of the non-PCPV/PCA audio channels stored on the digital master. That information will be provided to any downstream encoding process for transmission to a VRA-capable decoder. The VRA-capable decoder will then be responsible for the creation of the SCRA channel in real-time using downmix parameters specified in the auxiliary data. (There are a variety of ways to specify the SCRA channel fabrication and these will be discussed later in the section describing the features of VRA-enabling audio codecs.) To conclude the discussion of FIG. 3, the uncompressed digital master audio content 320 then creates a '1-channel, VRA-capable' digital master.

For further clarification, it should be noted that the act of downmixing is clearly not new and is used every day in audio engineering. Instead, the innovation described herein is related to the creation and transmission of the VRA-auxiliary data that enables construction of a secondary content remaining audio, to be further combined with the PCPV/PCV signal, for an easy two-signal VRA adjustment.

FIG. 3 shows a different perspective of an embodiment of a VRA-capable digital audio master tape or file. Note that the audio data may be blended with video data on the same tape and therefore, the VRA-capable digital audio master tape should not be necessarily construed as an audio-only tape format. Therefore, the entire digital mastering discussion applies equally well to the digital master for films, pre-recorded television programs, or musical recordings.

The embodiment shown in FIG. 3 will be referred to as a 'post-mix' VRA-capable digital master tape 315. As shown in this embodiment, the PCPV/PCA signal is created by blending audio content from any number of audio channels (which are considered as analog signals in the figure), and the SCRA signal is created by blending some other audio content considered to be 'remaining audio' before the signals are digitized as separate channels, alongside the audio content that has been created for the left, right, left surround, right surround, center, and low frequency effects channels. The eight tracks of information are stored using an uncompressed audio format (for example, but not limited to linear PCM) on digital tape.

Another embodiment, shown in FIG. 3, is referred to as the 'pre-mix' VRA-capable digital master tape 320. In this configuration, the fabrication of the VRA-capable digital master will only require that the PCPV/PCA and the SCRA signals are already mixed before the digital recording is mastered. As shown, there are now 'n' channels, where 'n' refers to an arbitrarily large number of audio channels that may reside on the digital master. This configuration may be necessary for certain types of digital masters that must be used later in downmixing processes used to create stereo or surround channel sounds for the audio program. The primary content pure voice and remaining audio, however, is mixed in advance and stored that way on the digital master.

Figure 4A:
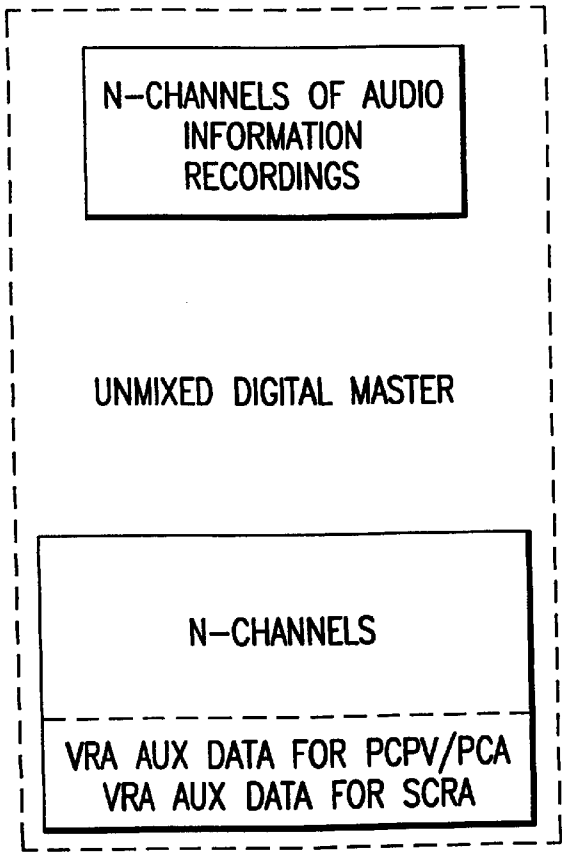
FIGS. 4A–E are diagrams illustrating various embodiments of VRA-capable digital master tapes or files.
Figure 4B:
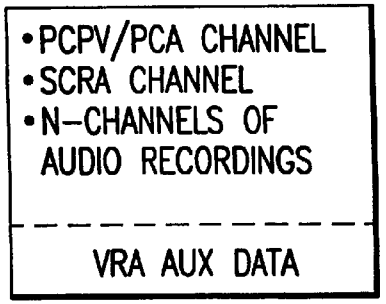
Figure 4C:
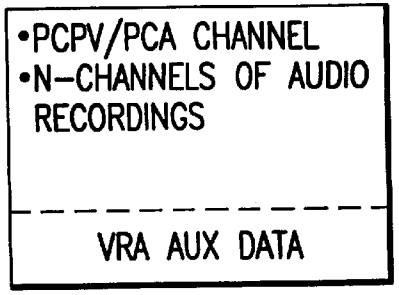

It should be clear that there are numerous embodiments of VRA-capable digital master tapes (files) as shown in FIGS. 4A–E. All versions of VRA-capable digital masters will be equipped with a special header file that identifies the master as VRA-capable. The header format is discussed in the next section. A pre-mixed, uncompressed, n-channel VRA-capable digital master is shown in FIG. 4A. For this case, the digital master consists of 'n' channels of audio that are recorded during the production. From some combination of those n-channels, it will be possible to specify the construction of a PCPV/PCA signal and a SCRA signal (FIGS. 4B and 4C).

To accomplish this, a VRA-auxiliary data channel can be created and stored on the master that provides those instructions at the decoding end of the production. Therefore, this digital master can be considered to be a '0-channel, uncompressed, pre-mixed, VRA-capable digital master.' The term 0-channel refers to the fact that there is no track on the master that explicitly contains the PCPV/PCA or SCRA signals. The essential point here is that the tape has sufficient information to enable the ultimate VRA adjustment by the end-listener who is in control of the playback device, even without those signals explicitly stored.

Figure 4D:
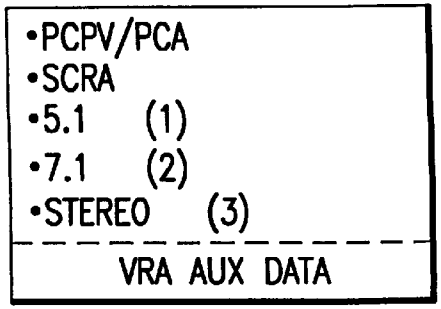
Figure 4E:
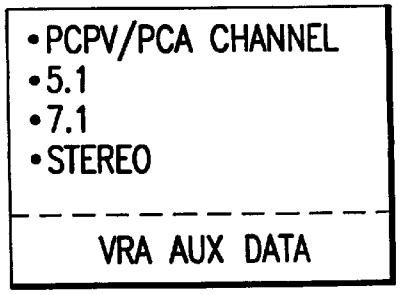

General schematics of other possible embodiments are also shown in FIGS. 4A–E. The most obvious embodiments are shown in FIGS. 4D and 4E. Those versions of digital masters can be considered to be a '1-channel, post-mixed, uncompressed, VRA-capable digital master' (FIG. 4E) and '2-channel, post-mixed, uncompressed, VRA-capable digital master' (FIG. 4D), respectively. In the post-mixed version, we find the typical stereo signals, the 5.1 mixed channels, or 7.1 mixed channels, or higher numbers of spatial channels, in addition to either the PCPV/PCA signal alone (the 1-channel version) or both of the PCPV/PCA and SCRA signals. In this situation, there may also be a VRA-auxiliary data channel in order to instruct the decoder about special playback features that should be used to provide spatial positioning of either of the two signals as the audio program progresses.

FIGS. 4D and 4E are other embodiments that have only the PCPV/PCA signals stored, along with the VRA-auxiliary data. For this case, the aux data will define how to construct the SCRA signal, playback the PCPV/PCA and the SCRA signals, and other functions described later.

To conclude this digital mastering discussion, it is clear that those skilled in digital audio may identify other embodiments than the ones shown explicitly in FIGS. 2A, 2B, 3, and 4A–E. For example, it is straightforward to consider compressed versions of all of the embodiments described above as directly defined by this invention. The important distinction is that all VRA-capable digital master versions also contain some kind of header that identifies the VRA-capable master contain an auxiliary data signal that defines certain properties, construction techniques, or playback techniques for the PCPV/PCA/SCRA signals. Therefore, the digital master formats shown in the figures are not to be construed as the only possible VRA-capable digital master configurations intended by this invention.

So far, the descriptions above had made it clear that the inclusive VRA-enabling process improves the digital audio processing art according to its wholistic merit, as well as in three distinct areas:

1) The process whereby a primary content pure voice audio signal is constructed in order to provide a signal that enables improved intelligibility and/or pleasure of the audio program's vocal content, with little or no loss in appreciation of the program's plot or lyrical meaning; said process also including construction of a secondary content remaining audio signal that enables improved appreciation for the artistic merit and/or enjoyment of the audio program but does not provide appreciable improvement in intelligibility or appreciation of the program's plot or lyrical meaning.

The creation of so-called 0-channel, 1-channel, and 2-channel 'VRA-capable' digital mastering tapes, using uncompressed or lossless/relatively lossless compressed audio formatting, said formats applied in order to retain optimal voice quality and optimal remaining audio quality that may be degraded in the event of VRA-capable mastering and/or transmissions based on very compressed audio formats (>8:1) that sacrifice audio quality.

The accommodation of primary content pure voice and secondary content remaining audio channels, a VRA-header, and/or VRA-auxiliary data in any number of lossless and relatively lossless audio codecs that are used to generate digital audio transmissions and/or archival audio file storage.

Now that the digital mastering process is defined, specific embodiments described below will focus on features that enables inclusion of the PCPV/PCA and SCRA signals in certain audio codec operations (to include encoding/compression and decoding) that are known to be lossless and relatively lossless compared to the losses that are associated with codecs in the class of AC3.

Digital Mastering Features for VRA-Capable Audio Programs

The desire to provide VRA adjustment capability to end-listeners should ideally be compatible with the artistic goals for the audio content of the program. Therefore, one feature of this invention seeks to describe a process whereby both goals—providing VRA capability and allowing artists to retain artistic license over the audio program—are compatible. Retention of the artistic merit will almost certainly require some degree of planning for the primary and secondary contents, followed by varied mixing of certain audio signals as the program evolves chronologically. The specific mixing and recording of a customized primary content pure voice channel and secondary content remaining audio channel is unprecedented in audio programming of any type.

Therefore, this digital mastering aspect of the invention is concerned with the situation where that has been inclusion of PCPV/PCA/SCRA signals on a digital master and there needs to be corresponding mastering of special 'header file' and/or 'auxiliary data' content that describes the essential information (location, sampling rate, format, playback parameters, etc.) about such PCPV/PCA and SCRA channels on the VRA-capable digital master.

To date, the advent of digital audio has mostly been concerned with new directions in spatial positioning of sound that relies on increased numbers of channels. This multi-channel, surround sound use for digital audio has led to the storage and transmission of increased numbers of audio channels compared to the more conventional stereo transmissions of the past years. VRA-capable audio files and transmissions will boost the storage and transmission requirements even higher because of the extra channels required for PCPV/PCA and SCRA information. Innovative VRA-capable audio codecs will be defined to minimize the extra throughput burden. In addition, the presence of VRA formats on a digital master will need to be 'identified' as a VRA-capable audio file by any audio codec used to compress/transmit/decode the incoming bitstream delivered from the digitally recorded master. There are two essential reasons that the digital master must be flagged as VRA-capable. First, the PCPV/PCA channel will need to be played back at specific speaker locations, therefore that channel must be time aligned with auxiliary data that describes the exact temporal/spatial playback procedure. Second, it may be required, as shown in FIG. 3, that the SCRA channel be constructed by the decoder. The instructions for creating that signal will also be programmed into the VRA-auxiliary data. We note that there will also be inventive ways to accommodate the VRA-auxiliary data as it enters the decoding process. For example, it may be introduced as embedded information in an n-channel bitstream for VRA-capable audio files or sent as a distinct channel.

Accommodation of PCPV/PCA and/or SCRA Signals in Audio Codecs

The embodiments described below enable a primary content pure voice signal and a secondary content remaining audio signal to reach the end-listener using the audio information defined earlier for the 'VRA-capable' digital master tape or file. The digital mastering discussion in the previous section described the storage and digital 'tagging' of the PCPV/PCA and SCRA channels in uncompressed or compressed audio format. The uncompressed format and relatively lossless compression (compression ratios <8:1) of the audio stored on the master was necessary in order to maintain the fidelity of the original audio signal, without question, at the mastering end of the audio production process. It is well known that digital audio compression enables more efficient storage and transmission of audio data. The many forms of audio compression techniques offer a range of encoder and decoder complexity, compressed audio quality, and different amounts of data compression. Now, this aspect of the invention is concerned with three parts: encoding methods based on lossless compression and relatively lossless compression algorithms, uses of the auxiliary information supplied by the VRA-auxiliary data and the encoding of the header file (or so-called 'digital tagging') that exists on the uncompressed VRA-capable digital master. The ISO MPEG II and MPEG IV standards rely on a relatively lossless compression algorithm (i.e. <8:1), so the MPEG audio formats will be used to illustrate certain features that include a VRA-encoder and a VRA-decoder. It will also be made clear that the embodiments described in this section will be applicable to other audio formats also. It is also noted here that conventional techniques do not teach the use of VRA-encoding or VRA-decoding as defined by the existence and special data handling of the so-called PCPV/PCA, SCRA, and VRA signals described in detail earlier in this document.

The embodiments for compressed VRA-capable digital audio will be described for the general case of lossless compression. The term lossless compression refers to the fact that upon decoding of the received compressed signal, it is possible to recreate, with no data losses whatsoever, the original audio signals that resided on the uncompressed digital audio master. The conventional techniques do not include the existence of audio codecs that are designed to recognize the presence of either PCPV/PCA or SCRA signals in the incoming PCM data stream nor are there existing audio codecs that will take advantage of the low-bandwidth of a voice-only signal (i.e. the PCPV/PCA signal).

Therefore, the descriptions provided in the following embodiments offer numerous unique features, including: the use of codecs with automatic recognition of VRA-capable uncompressed digital audio files; distinct treatment of the PCPV/PCA channel using audio compression algorithms designed specifically for speech signals, time synchronized with the other audio tracks that are compressed using more general audio compression algorithms and re-mixed at the decoder, compression of the VRA-capable digital audio information using lossless compression algorithms, compression of VRA-capable digital audio using lossy compression algorithms that retain more digital data than the AC3 algorithm (specified here to mean compression ratios less than or equal to 8:1), fabrication instructions for the SCRA channel in the event of a 1-channel VRA-capable digital master, playback location specifications used by the VRA-decoder for assignment of the PCPV/PCA and SCRA channel information to specific speakers, methods for any required spatial positioning of the PCPV/PCA signal, and specific features of VRA-capable encoders that will incorporate the PCPV/PCA and SCRA channels in a variety of already existing audio codecs.

Figure 5:
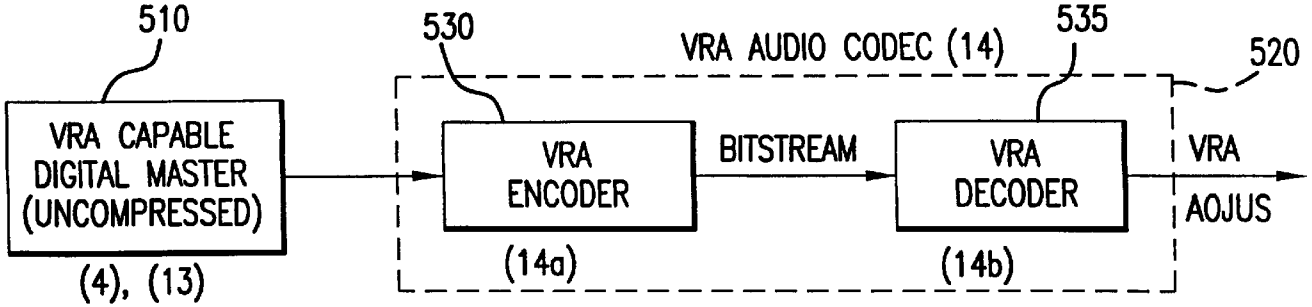
FIG. 5 is an exemplary diagram of a VRA codec.

FIG. 5 shows a basic block diagram that illustrates the key concept of this part of the invention based on a general, lossless compression algorithm. (One example of a lossless compression algorithm is the Meridian Lossless Packing (MLP) algorithm.) For this example, an uncompressed VRA-capable digital master 510 is used as input to the VRA audio codec 520. The distinction here is that there must be a VRA-capable encoder 530 and VRA-capable decoder 530 used at the encoding and decoding ends of the codec 520, respectively. The output of the VRA-capable decoder 535, and hence the output of the audio codec, will be the voice and remaining audio signal that can be independently adjusted by the end-listener. Next, the VRA-capable components in the audio codec 520 are discussed.

VRA-Capable Encoders

Figure 6:
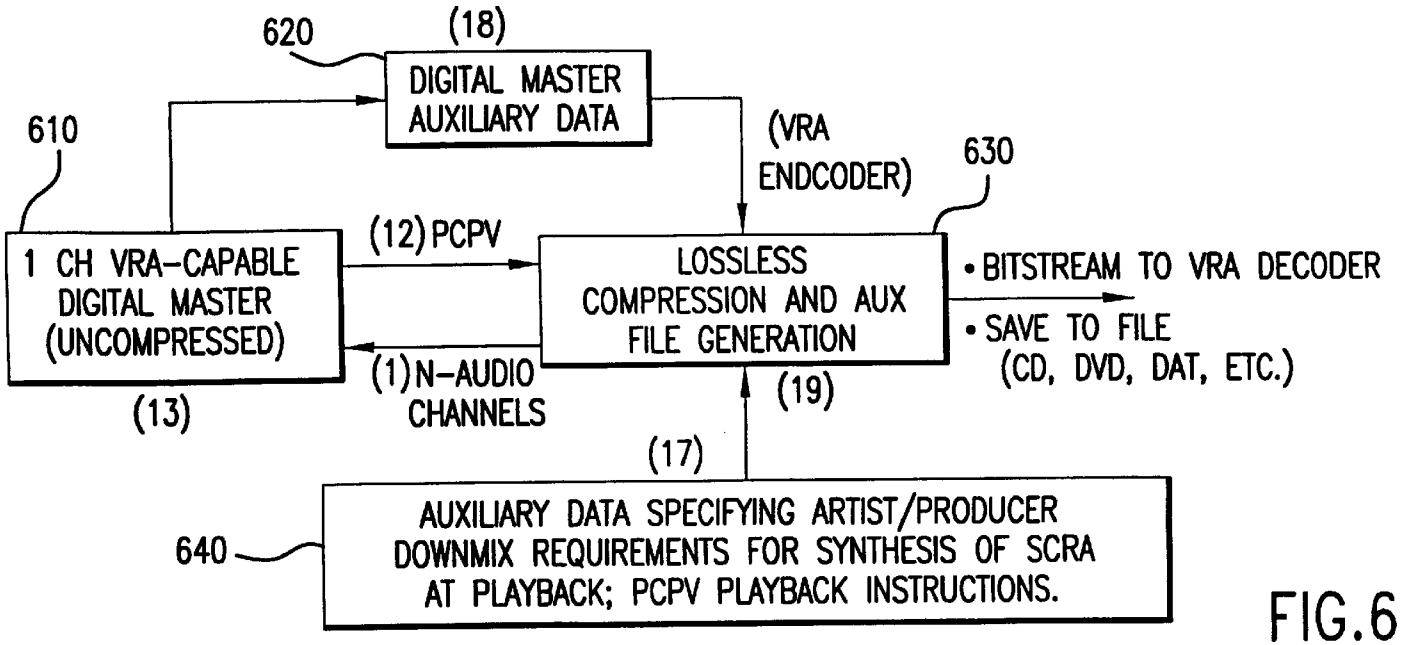
FIG. 6 is an exemplary diagram of a VRA encoder for a 1-channel VRA-capable, uncompressed digital master.

A conceptual embodiment of a VRA-capable encoder is illustrated in FIG. 6. This illustration relies on the previous description of a 1-channel, n-compressed, pre-mixed VRA-capable digital master 610. However, the essence of the description will remain the same no matter what format of VRA-capable digital master is introduced at the input to the audio codec. The diagram of FIG. 6 is intended to illustrate that the pre-mixed PCPV/PCA signal is sent into the encoder's lossless compression algorithm 630 alongside the 'n-channels' of other audio information. Pre-recorded information residing in the VRA auxiliary data 620 may also be sent into the encoder. A software interface may also be used to create all or additional portions of the VRA-auxiliary data 640 at the mixing/encoding/compression stage in the production process. This feature will allow producers to pass along the VRA authoring task to secondary providers who may subcontract the task.

Figure 7:
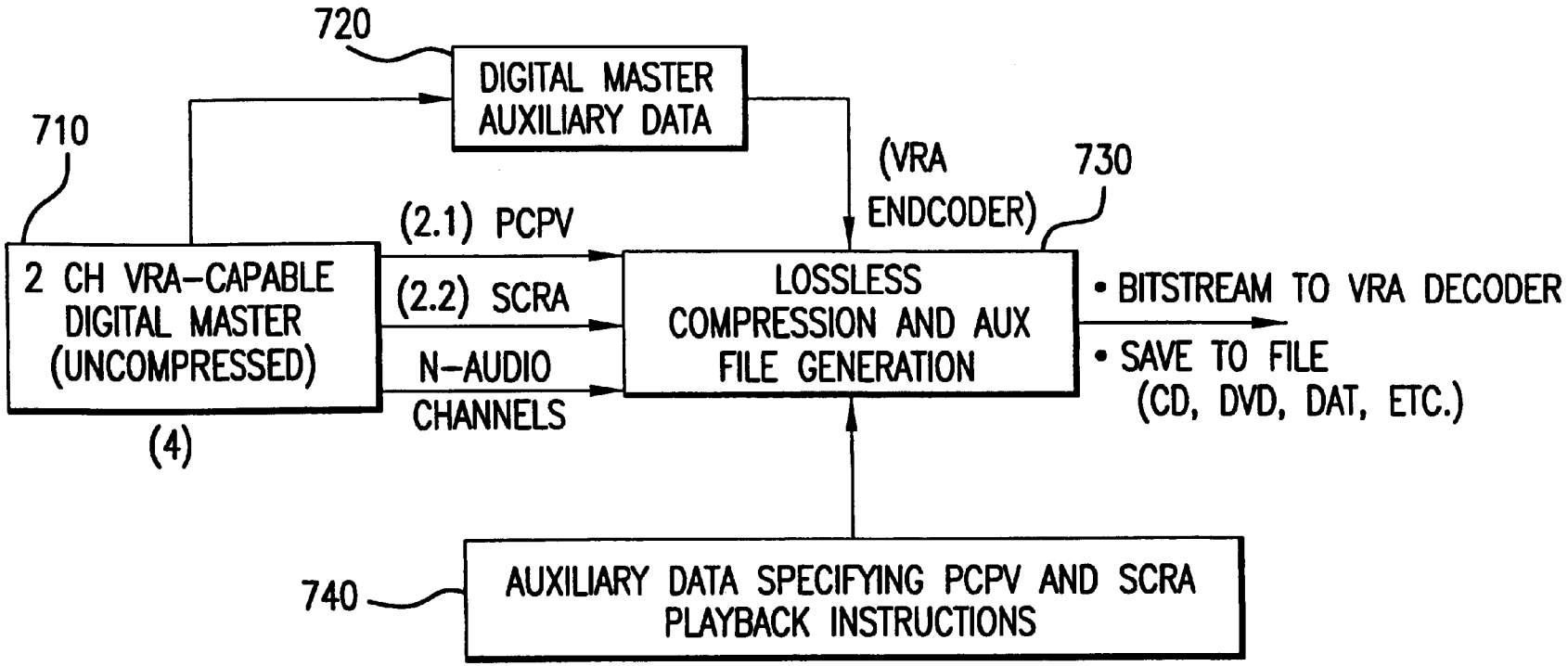
FIG. 7 is an exemplary diagram of a VRA encoder for a 2-channel VRA-capable, uncompressed digital master.

Finally, the compressed, and possibly mixed audio and auxiliary data is stored in the compressed format or transmitted to a decoder as an ISO bitstream created as part of the encoder process. The PCPV/PCA signal and the SCRA signal, should they be premixed at this stage, will be built into the MPEG-based bitstream standard in the manner that is currently practiced by anyone skilled in the art of digital audio. FIG. 7 is a similar illustration as shown in FIG. 6 (the description of the features will not be repeated). The exception is that the digital master is now a 2-channel VRA-capable format. Other than the presence of the SCRA signal at the input to the codec, the descriptive features are identical to those discussed for FIG. 6.

FIGS. 8–11 are specific configurations of four different embodiments for VRA-capable encoders that rely on some combination of the following: an algorithm for lossless or relatively lossless compression of general audio signals, a speech-only compression algorithm, accurate processing of the VRA header and auxiliary data information, and the input of some form of VRA-capable digital master. It is emphasized that various combinations of these various features are too numerous to mention here but are all consistent with the intent and overall VRA-capable audio production process outlined in this invention.

Figure 8:
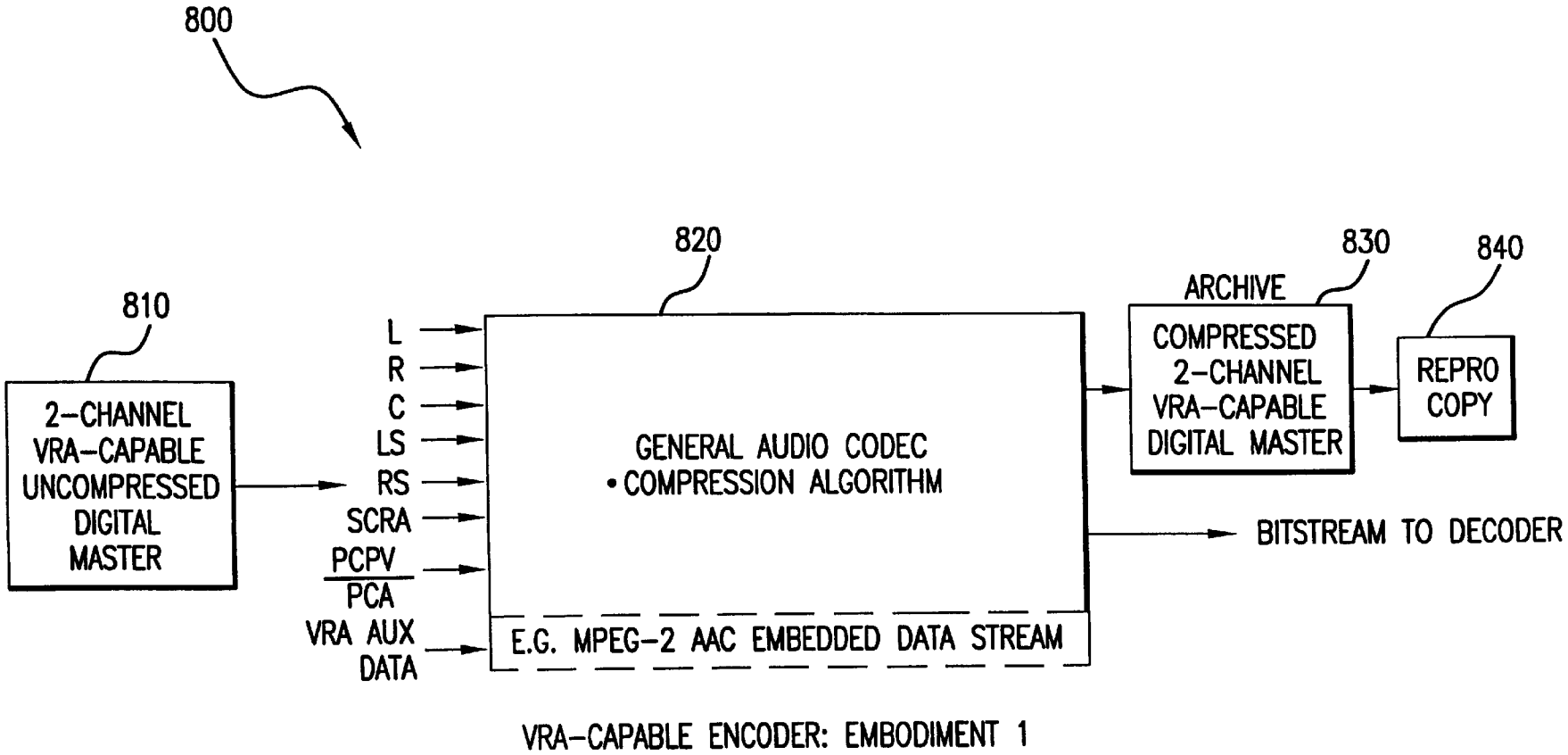
FIG. 8 is an exemplary diagram illustrating another possible embodiment of a VRA-capable encoder.

Referring first to FIG. 8, a 2-channel, post-mixed, uncompressed, VRA-capable digital master 810 is shown as the input to a VRA-capable encoder. The left, right, center, left surround, right surround, SCRA, and PCPV/PCA signals are already mixed for this format of digital master and are then compressed by a 'general' audio codec's compression algorithm 820. The algorithm 820 may be perceptual-based, or redundancy-based, or any other technique that leads to compression without regard to bandwidth.

The VRA-auxiliary data is also operated on by the compression algorithm, then arranged into the ISO bitstream using standards-based procedures. For example, the MPEG-2 AAC (advanced audio codec, ISO/IEC 13818-7) maybe used to deliver the VRA-auxiliary data via one of the fifteen embedded data streams that the standard supports. There are other ways to arrange the auxilary data, and those ways are well-known to those skilled in the art. The output of the codec 800 can be used to store a compressed version of the 2-channel master and that master will then be used to create reproductions for distribution. Alternatively, the bitstream can be transmitted directly to a decoder in a playback device, such as a media player in a PC.

Figure 9:
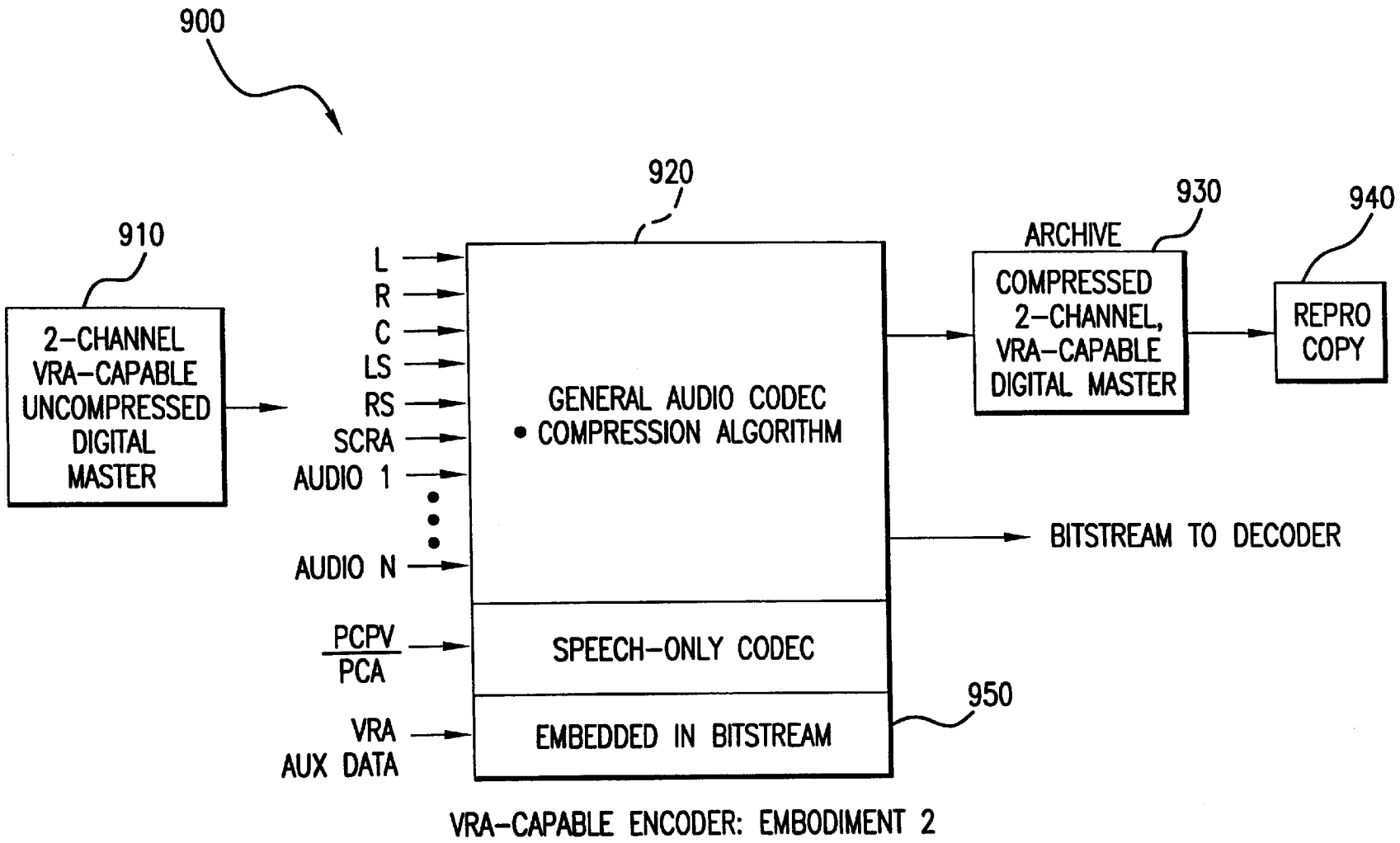
FIG. 9 is an exemplary diagram illustrating another possible embodiment of a VRA-capable encoder.

The process implied by FIG. 9 is similar to the previous one of FIG. 8 except for two distinctions. First, the PCPV/PCA signal is compressed with a speech-only codec 920 while the other audio signals are compressed using a general compression algorithm 820. Speech coding can be conducted using any one of several known speech codecs such as a G.722 codec or the Code Excited Linear Predictive (CELP) codec. This distinction between compression of the PCPV/PCA signal using a speech-only codec 920 and compression of the other audio signals using a general codec will help to reduce the required bandwidth for VRA-capable bitstreaming and storage requirements.

It is to be noted that the VRA-capable encoder being disclosed is this manner in which the cumulative information (PCPV/PCA, SCRA, VRA-auxiliary data) is included, thereby making the audio format VRA-capable, as well as the two-tiered compression approach that reduces the bandwidth requirements for VRA-capable audio transmission. The second important distinction of this figure is the presence of the additional 'n audio channels'. This embodiment accomodates the situation where there may be a need for additional audio channels that will enhance the PCPV/PCA or SCRA signals upon playback. Those additional signals are compressed by the general compression algorithm and any special playback requirements will be defined by the auxiliary data stream.

Figure 10:
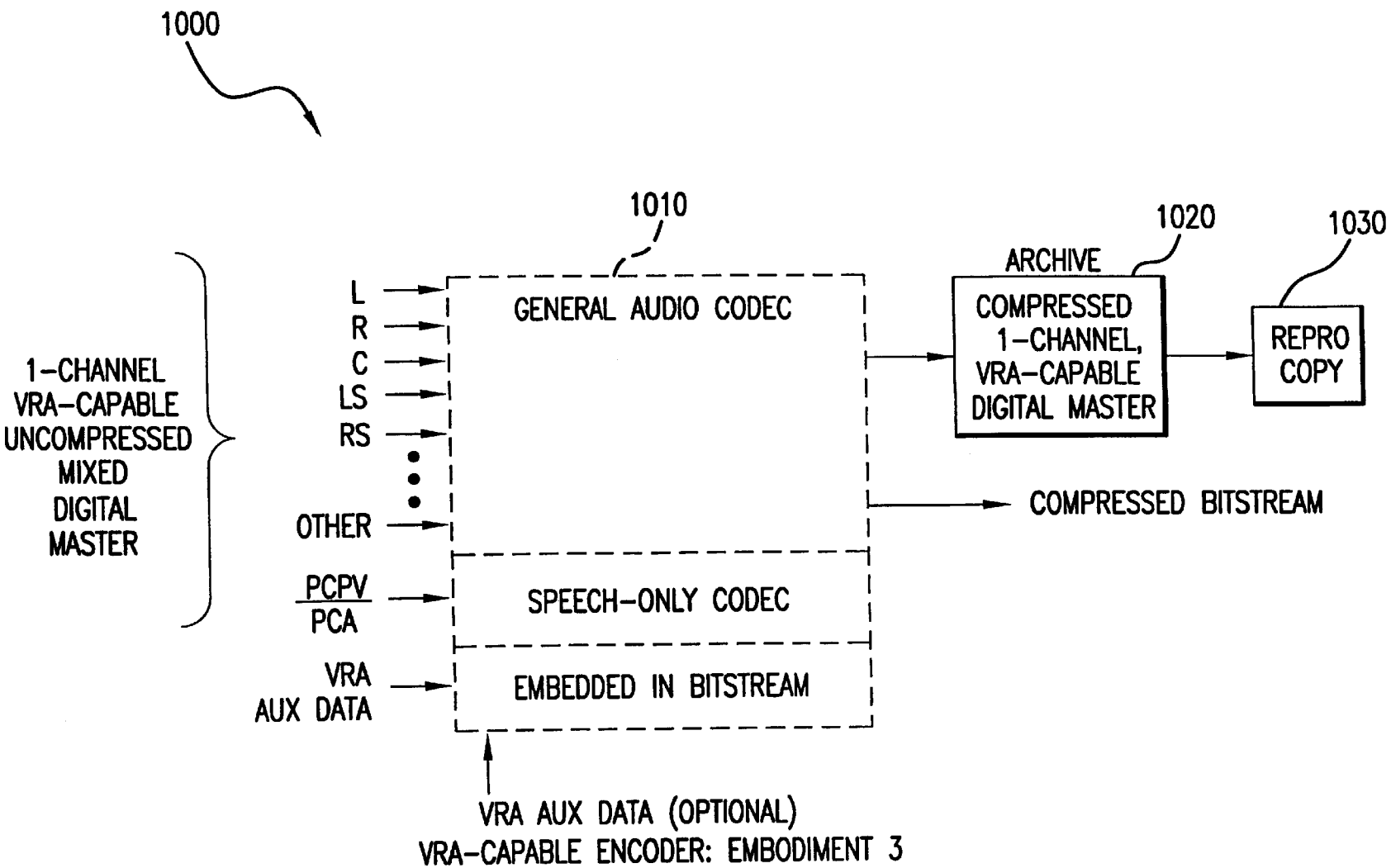
FIG. 10 is an exemplary diagram illustrating another possible embodiment of a VRA-capable encoder.
Figure 11:
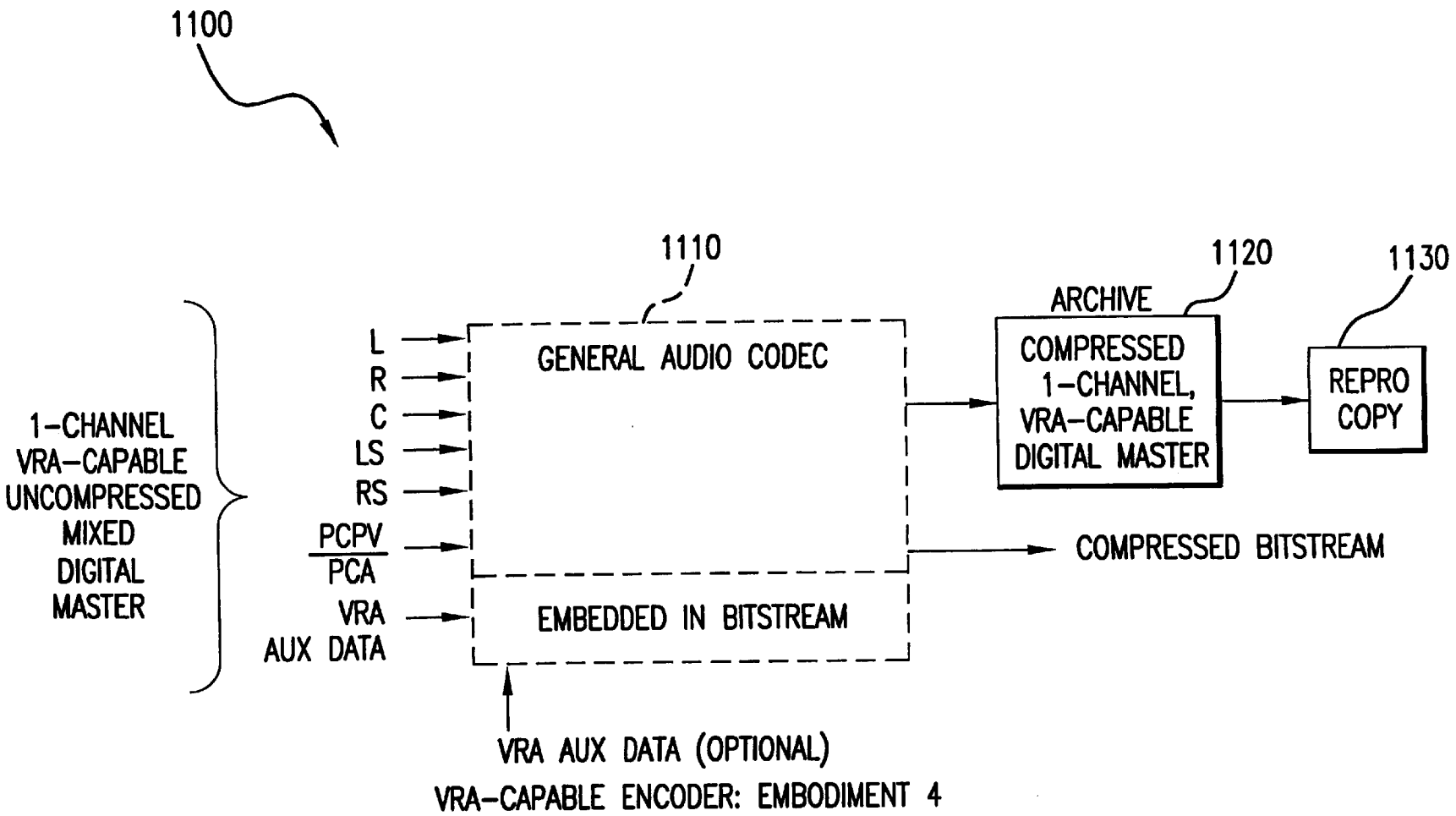
FIG. 11 is an exemplary diagram illustrating another possible embodiment of a VRA-capable encoder.

FIGS. 10 and 11 illustrate two VRA-capable encoder configurations that would lead to compression of a 1-channel, uncompressed, mixed, VRA-capable digital master. As before, it may be desirable to use a speech-only codec for the PCPV/PCA signal (see FIG. 10) or the encoder can be set-up to use a general audio compression algorithm for all signals as shown in FIG. 11.

Figure 12:
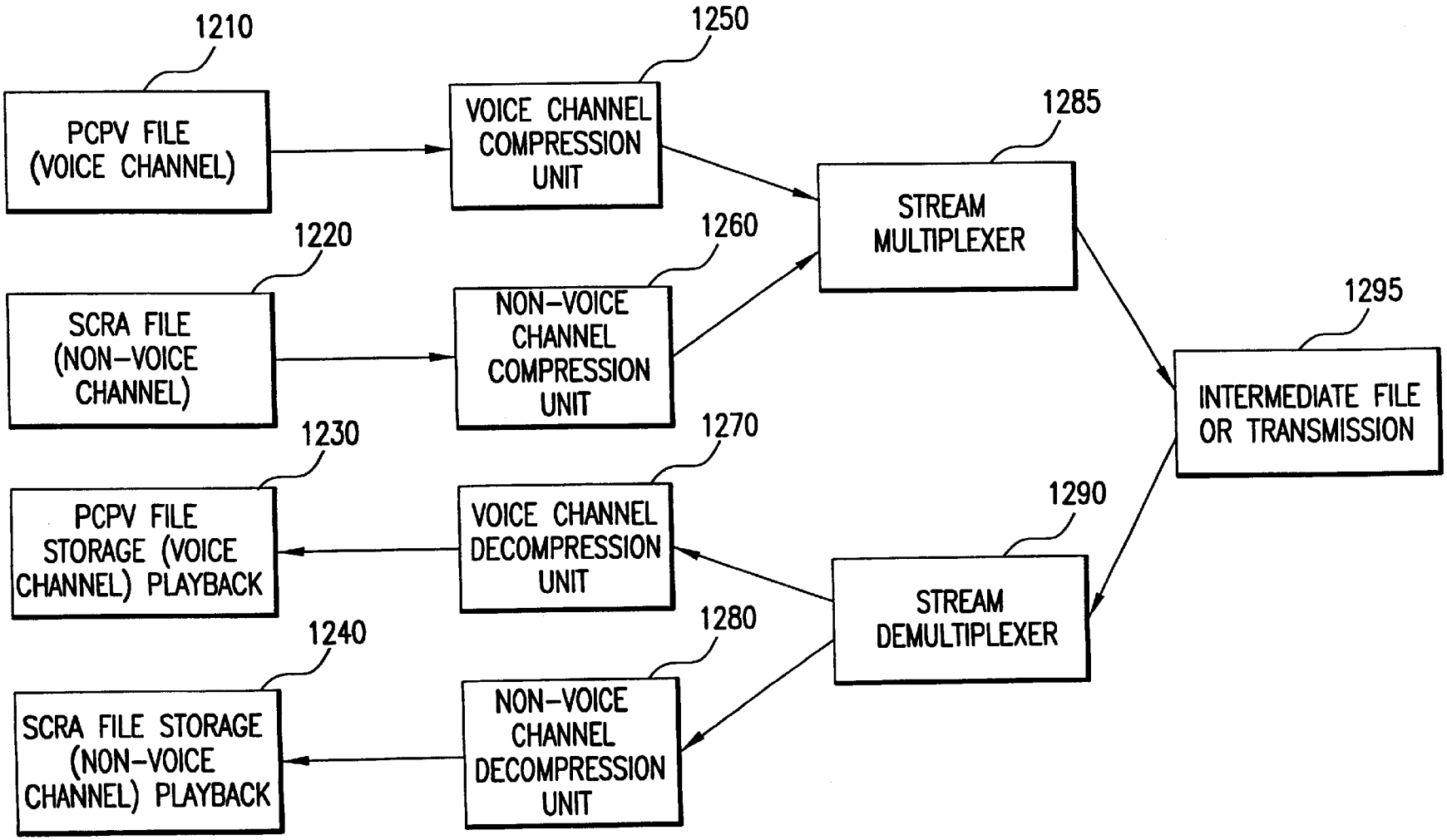
FIG. 12 is an exemplary diagram illustrating another possible embodiment of a VRA-capable encoder.

FIG. 12 shows a second representation of certain conceptual architecture for a VRA-capable codec. The essence of this representation is similar to the embodiments of FIGS. 9 and 10 in that the voice information residing in the PCPV/PCA signal(s) is compressed using a speech-only compression algorithm and the SCRA signal(s) is compressed using a more general, wider-bandwidth, audio compression algorithm. Referring to FIG. 12, elements 1210 and 1220 are the digital representations of the PCPV/PCA and SCRA signals (respectively) before compression and likely in the conventional LPCM format. Notice that the digital information might also be available as a .WAV file, as indicated, or some other form of uncompressed digital audio file. The two audio streams are considered to be in parallel at this stage, which is an important distinction over previous audio compression architectures.

By contrast, the conventional audio compression process would be to feed a serial, single-channel audio stream that has both voice and non-voice components into a compression algorithm. It is possible to recognize when the serial bitstream is primarily voice or primarily non-voice, and invoke varying sampling speeds and perhaps even different compression algorithms as the content of the serial bitstream varies between primarily voice and non-voice.

Thus, the conventional technique is quite different than the embodiment set forth in FIG. 12. In FIG. 12, the two parallel streams are fed into two distinct compression algorithms all of the time; as shown by the parallel arrangement of compression units 1250 and 1260. A speech-only compression unit 1250 includes any compression algorithm known to those skilled in the art. The PCPV/PCA information is input to that compression unit 1250 and the SCRA signal(s) residing in 1220 are input to a general audio compression unit 1260 in a manner that is exactly in parallel (time-synchronized between the PCPV and SCRA) with the voice-only compression of compression unit 1250.

The audio is also considered to be time-synchronized and video-frame synchronized with any related video content, for example, the corresponding video and audio content of a major motion picture. The outputs of compression units 1250 and 1260 are then multiplexed in a specific manner by 1285 so that the interlaced VRA audio can be stored as an intermediate file or transmitted over some digital medium 1295. The demultiplexing process 1290 unwraps the distinct PCPV/PCA information and SCRA information for respective decompression by decompression units 1270 and 1280, respectively. Finally, the decompressed PCPV and SCRA information may be archived if desired or more likely, at this stage, will be sent directly to the playback device for separate volume controls, similar to the description for FIG. 13 as discussed below.

Also in FIG. 12, a VRA codec is created that is compatible with virtually any other existing voice-only or general audio compression and decompression algorithms. We emphasize that compression units 1250 and 1260 can be use algorithms, in their respective classes of voice-only and general audio compression, due to the unique operation of the multiplexer 1285 that accommodates the parallel input architecture of the PCPV and SCRA signals. Furthermore, the multiplexer 1285 may also include an encryption unit or algorithm for either the PCPV/PCA signal and/or the SCRA signal, in order to provide for secure transmission of these parts. The encryption of the signals can be performed by any technique known to those skilled in the art.

Creation, Contents and Functionality of the VRA Auxiliary Data Channel

The auxiliary channel itself will consist of a variety of information about the primary content pure voice (PCPV) audio signal and the secondary content remaining audio (SCRA) signal. Those features, their functionality, and ways in which that data can be created are discussed in the following bullets:

Presence of VRA capable program—Likely to be included in the header file, this information can be expressed as a single bit indicating on or off. If the bit is one, a VRA capable program has been created using the VRA audio format described earlier (i.e. the PCPV and SCRA audio exist). This bit will be set by a software or hardware switch at the production level if the audio engineer uses the VRA production techniques. Otherwise, the audio program is considered to be based on conventional mixing practice.

Number of PCPV and SCRA channels—This information can be preceded by a flag that indicates more than one of each channel is present. If it is indicated so, then further information is provided as to the number of spatial channels that are available in each of the PCPV and SCRA programs. There is no specific limit set to this number herein, but will likely be dependent on the playback hardware (e,g, 5 speakers=5 available channels). These numbers tell the decoder how many audio channels will be present for decoding (for example 3 PCPV channels and 5.1 SCRA channels). The audio production engineer will specify the number of channels required for the decoder to construct each of the two audio programs (PCPV and SCRA) based on the artistic interpretation given to each scene. In order to conserve bandwidth, the digital word containing the PCPV and SCRA number of channels may vary as a function of time if the number of available audio channels changes within a program or between programs.

Production Mix Data—Both amplitude and spatial information about how to construct the PCPV/PCA and SCRA signals can be encoded as part of this data block. This information, combined upon playback with the decoded audio programs, will recreate the original production mix. {Although the ultimate purpose for this invention is to allow the end-listener to adjust the VRA, it will be required that nominal playback instructions be provided before adjustments by the user are applied. Stated otherwise, any adjustment by the end-user will operate on the production mix levels as a starting point.) Continuing, for example, if the preceding data (Number of PCPV and SCRA channels) instructed the decoder that one of each of the two programs was available (one PCPV channel and one SCRA channel), then the production mix data might indicate that both signals should be played back on the center speaker with the PCPV level of 1.0 and the SCRA at a level of 1.2 (for example).

Therefore, the producer's original intent is realized through the use of the actual volume levels and balance adjustments performed at the mixing stage of the production process. Alternatively, as a result of this invention the end listener now receives the ability to override the original production mix and create his own mix of voice to remaining audio. In order to seamlessly integrate this production mix data (which will include not only amplitude information for all PCPV and SCRA channels, but spatial information for all channels as well), it is possible to design a software algorithm that will detect the knob location of a spatial positioning control and an amplitude control and transfer that information directly into the VRA auxiliary data channel as a function of time.

Continuing with the previous example, the producer may lower the SCRA audio during a time in the program where the SCRA should be soft compared with the PCPV. This movement and subsequent new level is detected by the algorithm and recorded in a data file that is transformed into the VRA auxiliary data file format. The amplitude production mix data will also allow the user to establish uniformity among different programs automatically for both the PCPV and SCRA signals separately. This will allow the voice to remain at a constant SPL between commercials and programs as well as the remaining audio (which could obscure the voice if this information is not available).

It should also be noted that if the producer creates the PCPV and SCRA signals (multi-channel or not) so that when linearly added together the exact production mix is created, there is no need to transmit all of the amplification and spatial location information for recreation of the production mix at the decoder end. If this data is not included in the VRA auxiliary channel, the decoder will automatically default to a linear combination for the production mix, resulting in the exact production mix playback of the original program.

PCPV and SCRA Specific Metadata—There is a variety of metadata that can be used to further enhance the playback features available with dual program audio (PCPV and SCRA). First, in order to have the decoder regulate the level of both the PCPV and SCRA signal during playback, in the presence of transients, level information may be included. This would simply involve a signal strength detector translating its output to a data file that is time-synchronized with the actual audio of both the PCPV and SCRA signals. The decoding process can then utilize this data to automatically control the volume level of each of the signals with respect to one another so that the SCRA does not obscure the PCPV during certain types of program transients. Dynamic range information of both the PCPV and SCRA channels can also be encoded through a similar process. This would allow the user, upon playback, to control the dynamic range of each of the two signals (SCRA and PCPV) separately thereby allowing whispers to be loud enough to hear (expansion) or explosions to be soft enough to not disturb (compression). The key to this is that both signals can be controlled independently. Either the program provider will be responsible for entering this information as part of the auxiliary data bitstream during production or software driven algorithms can determining the signal strength over time and generate such data automatically.

Inclusion of the VRA Auxiliary Data Channel in Standard Metadata Bitstreams

The contents of the auxiliary data bitstream discussed in detail above may be included as a new part of the metadata in any conventional CODEC. Typically commercial CODEC's transmit two types of information: the audio and the metadata (information about the audio). In the embodiments discussed herein, the format of the audio and the format of the metadata required to reproduce that audio with VRA control capability are described in detail.

The method for including the VRA auxiliary data will be CODEC dependent. Literally countless CODEC's exist and therefore there are countless specific ways in which the auxiliary data can be included in the metadata portion of a particular CODEC. However, since most metadata formats will have locations set aside for additional data, that is typically where the VRA auxiliary data will be stored. This therefore, implies that the decoder must be "VRA aware" and find the VRA auxiliary data in the predetermined vacant locations of the original CODEC's metadata stream. Therefore, another essential feature of the VRA-header data is the identification of the manner in which the VRA-auxiliary data has been placed in the metadata for the CODEC.

At this juncture, it is important to stress that the unique difference in the metadata for VRA-capable audio codecs is that the information contained in the VRA auxiliary data channel teaches about the creation of two uniquely desirable, separate signals: the PCPV and the SCRA. Conventional techniques can only create metadata (dynamic range information for example) for an entire audio program that conforms to the prior art audio formats such as Dolby Pro-Logic or 5.1. However, it will be possible to utilize certain aspects of the conventional metadata structure in order to enable VRA-capable audio productions. For example, if the dynamic range information for the PCPV channel AND the SCRA channel were to be transmitted, it would be useful to include a flag that indicates that the SCRA dynamic range is located in the same location in the metadata file for dynamic range settings associated with conventional art audio formats. Then, only the dynamic range information for the PCPV needs to be secured in a vacant bit location of the original metadata channel.

Specific Compression Algorithms for Use in VRA-Capable Audio Codecs

Implementation of compression algorithms to minimize throughput and storage requirements is widely practiced by digital audio engineers and companies. For the VRA embodiments introduced earlier, it has already been discussed that it may be necessary to utilize compression algorithms that provide less lossy compression than the AC3 format. It has also been discussed that the embodiments introduced earlier are distinctly different than the Dolby HI Associated Service. A clarification is provided below.

Use of Generic CODEC in Conjunction with VRA Production Techniques with Special Application to the Dolby Digital CODEC The primary embodiments disclosed herein are independent of the compression techniques of any specific CODEC. As an example, consider that a producer can generate a multi-channel surround program that includes two channels of surround audio, three channels of front audio, and a smaller bandwidth subwoofer channel. This is an audio format known as 5.1 surround sound. This program can be encoded by any CODEC which may include Dolby Digital, DTS, MPEG, or any other coding/decoding scheme. The audio format itself is independent of the coding scheme. Likewise, a mono channel program can be encoding and decoded by any such CODEC.

The focus of this invention is not the CODEC itself but the audio format. All prior audio formats have been restricted to providing the end user with spatial information alone. The audio format proposed herein provides the user with the ability to adjust the ratio, frequency content, dynamic range, normalization, etc. of multi-channel voice to multi-channel remaining audio by including content information in the audio format in addition to spatial information.

There are two distinct differences in the existing technology described in the *Guide for Television Standard,* which discusses the Dolby Digital (AC-3) CODEC. As an inherent part of that standard, a single channel voice is permitted to be transmitted in conjunction with the multi-channel remaining audio. As an additional embodiment, two channel voice and two channel remaining audio is also permitted. In practice, this is very limited for the producer and inevitably requires re-production of the original program to locate all relevant voice to a single channel. In addition, the voice can only be played back on a single channel in this implementation. Most multi-channel programs require that both the secondary content remaining audio AND the primary content pure voice be multi-channel programs (since critical voice and remaining audio segments are not restricted to a single spatial position). Therefore, in light of the existing technology, it is evident that the embodiments disclosed herein have two distinct advantages:

Multi-channel capability—the VRA audio format permits multi-channel PCPV AND multi-channel SCRA allowing the producer to exercise all artistic liscense necessary while still allowing the user to select the desired ratio.

CODEC Independence—The VRA audio format has been designed to operate independent of any CODEC specifics and can thus be used with any CODEC. The hearing impaired associated service in the *Guide for Television Standard* can only work as laid out in the Dolby Digital specification.

Therefore, the VRA audio format specified in this document can be used WITH Dolby Digital as a CODEC. The specified VRA audio format includes the needed auxiliary data for playback of the multi-channel PCPV and multi-channel SCRA at the users control. This auxiliary data can be included in the metadata portion of any audio CODEC (including but not limited to Dolby Digital) and the audio information of PCPV and SCRA can be compressed, (or not) according to the CODEC specification itself, where for the AC-3 compression scheme may result in large losses and high compression ratios depending on the audio program content.

The feature of CODEC independence is an important one for support of the VRA enabling features across software platforms. It is important to provide the end user with the ability to control the voice to remaining audio in a multi-channel setting. While AC-3 includes a single channel mechanism for accomplishing this goal, other CODEC's may not or do not. This invention allows the producer to "level the playing field" when choosing a CODEC to work with. The CODEC can be chosen based on the performance of the compression and decompression algorithm rather than the ability to perform VRA. This allows all CODEC's to provide the VRA functionality to the end user.

Therefore, a VRA-capable codec could be made compatible with virtually any existing audio compression algorithms. Therefore, this invention includes the creation of numerous VRA-capable compression formats, based on the prerequisite VRA auxiliary data, PCPV/PCA signal and possibly the SCRA signal. Based on this, it is clear that the following digital audio formats will support the generation of a VRA-capable version using the embodiements described earlier and may serve as the compression algorithm to be used as part of the VRA audio codecs described above:

DTS-VRA-capable compression

Optimized PCM VRA-capable compression

Meridian Lossless Packing VRA-capable compression

MP3 compression with a speech-only codec accompaniment

Dolby Digital, AC3—VRA-capable compression

MPEG-2 VRA-capable compression

MPEG-4 VRA-capable compression

There are numerous other compression algorithms that may be used in VRA-capable codecs and those are well-known by those skilled in the art. The accommodation of VRA-capability in those algorithms will have to be based on identification of the incoming VRA information, followed by special treatment of the VRA channels and the auxiliary data. There will be numerous ways to accomplish this at the standardized bit-streaming level but those methods are straightforward for anyone versed in the standards of digital audio. It is the inclusion of PCPV/PCA/SCRA signals and aux data in any of these compression algorithms that is one of the many aspects of the invention disclosed herein.

VRA-Capable Decoders

There are a number of functional descriptions that illustrate the features that will be required for VRA-capable decoders at the playback end of the VRA-audio production process. Those descriptions are provided below.

VRA-header recognition: The decoder will be equipped to recognize the different bit patterns used for the VRA-header data. The particular value of the header will determine how the decoder accomodates the incoming VRA-capable bitstream. This feature can be implemented in various ways by those skilled in the art. For example, it is possible to use a bit masking technique, logic operations, or other methods to indicate VRA-capability of the incoming bitstream.

Mode-switching: The decoder will be programmed to toggle between conventional decoding software for multi-channel audio playback (e.g. 5.1 audio or 7.1 audio) or a VRA-playback mode where the PCPV/PCA and SCRA signals will be include the playback signals sent to the speakers attached to the playback device.

Signal Routing: The decoder will utilize the information in the VRA-auxiliary data to determine the appropriate spatio-temporal playback information for the PCPV/PCA and the SCRA signals.

Backwards Compatibility: The decoder will be able to accommodate the playback of non-VRA-capable audio programs also. This will be accomplished by using the logic output of the VRA-header recognition function discussed earlier.

More details about the decoding and playback features are described below.

End User Controls and Ultimate Functionality of the VRA Auxiliary Data, PCPV and SCRA Channels at the Playback Location As discussed in detail above, the VRA auxiliary data contains various information about the PCPV and SCRA channels being transmitted or recorded via the CODEC. In addition to the information being delivered to the end user in the auxiliary data, there are several decoder specific functions that can be implemented (that are not present in prior art) as a result of having the PCPV and SCRA channels delivered separately. The two types of functions (auxiliary data control and PCPV/SCRA decoder control) are detailed in the following bulleted items with specific reference to the operation of the decoder itself.

VRA Auxiliary Channel Identification—Existing as part of the VRA auxiliary channel header file, the decoder will recognize the existance of the VRA Auxiliary channel by polling the specified bit. If the bit is zero (off) then the decoder recognizes that there is no VRA auxiliary data and thus no separate PCPV or SCRA channels. The decoder can commence decoding another audio format (such as stereo). If the decoder recognizes that the identification bit is one (on) then the decoder can, if desired by the end user, decode the PCPV and SCRA channels separately and conforming to the specification provided by the CODEC used to record or broadcast the data originally. The identification bit simply makes the decoder aware that the incoming data is VRA capable (i.e. contains the PCPV and SCRA components) and can change for any programming.

Production/User Mix—This feature represents a user input rather than a piece of information contained in the VRA auxiliary data channel itself. The user has the option to select the production mix or the user mix. If the user mix is selected, a variety of audio control functions can be employed (discussed next). The production mix setting will likely be considered as the default setting on most decoder settings.

If the production mix is selected, the decoder will then collect the amplification data and the spatial location data on each of the PCPV and SCRA channels from their specified location in the VRA auxiliary channel embedded in the metadata portion of the CODEC. This amplification and spatial location data represents the audio production engineer's original intent in creating the audio program (and is created as discussed in the encoding features section). For each channel of spatial information and each of the two signals (PCPV and SCRA) the amplification data is applied through a multiplication operation.

If spatial positioning information is required (if for example there is a single voice track that can move from one speaker location to another), then that information is applied to the appropriate channel as a repositioning command. Since the amplification and position of the PCPV with respect to the SCRA will change with time (depending on the activity of the producer), the decoder will always poll the auxiliary channel data and continually update the settings applied to each of the PCPV and SCRA signals and associated channels.

It should also be noted that if the PCPV and SCRA channels are heavily produced so that a simple addition of the respective channels within each of the PCPV and SCRA signal results in the exact production mix, there is no need to transmit amplification or spatial location information in the VRA auxiliary data channel. If this data is not present, the decoder (when in the production mix mode) will default to a linear combination (of the respective channels) to achieve the production mix. The end user control of this function can be software driven through a soft menu (such as on screen) or hardware driven by a simple toggle switch that changes position between the production and user mix selections.

User Level/Spatial Mix—If the user mix toggle mentioned above is selected, the production mix is disabled and the end user now has complete control over the PCPV and SCRA signals. The most rudimentary adjustment (and perhaps the most useful) is the ability to control the level and spatial positioning of the PCPV and SCRA signals and their associated channels independently of one another.

Depending on the audio format, each of the PCPV and SCRA channel may contain a multitude of spatially dependent channels. Since all of the spatial channels are independent, and (in the VRA audio format) the PCPV and SCRA signals are independent, the user will be provided, via the decoder hardware and/or software, the ability to adjust the amplitude (through multiplication) and spatial position (through relocation) of each of the independent signals. Providing this functionality to the end user does not require any additional bandwidth, i.e. no auxiliary data is needed. The amplitude and spatial positioning is performed on the two signals (PCPV and SCRA) and their indpendent channels as part of the PLAYBACK hardware or software (volume knobs and position adjustments), not the decoder itself. This hardware may be included with the encoder as a single unit, or it may operate as an additional unit separate from the decoder.

The above descriptions represent the most general sets of adjustments that may be made by and end user whose desire it is to control the entire spatial location and amplitudes of each of the multiple channels within each of the two signals (PCPV and SCRA). However, the most general adjustment capabilities will likely be far too complicated for the standard user. It is for this reason that another embodiment is described, that permits end user adjustment of the ratio of voice to remaining audio via an easy (user friendly) mechanism that will be made available as an integral part to any VRA capable consumer electronics device.

Figure 13:
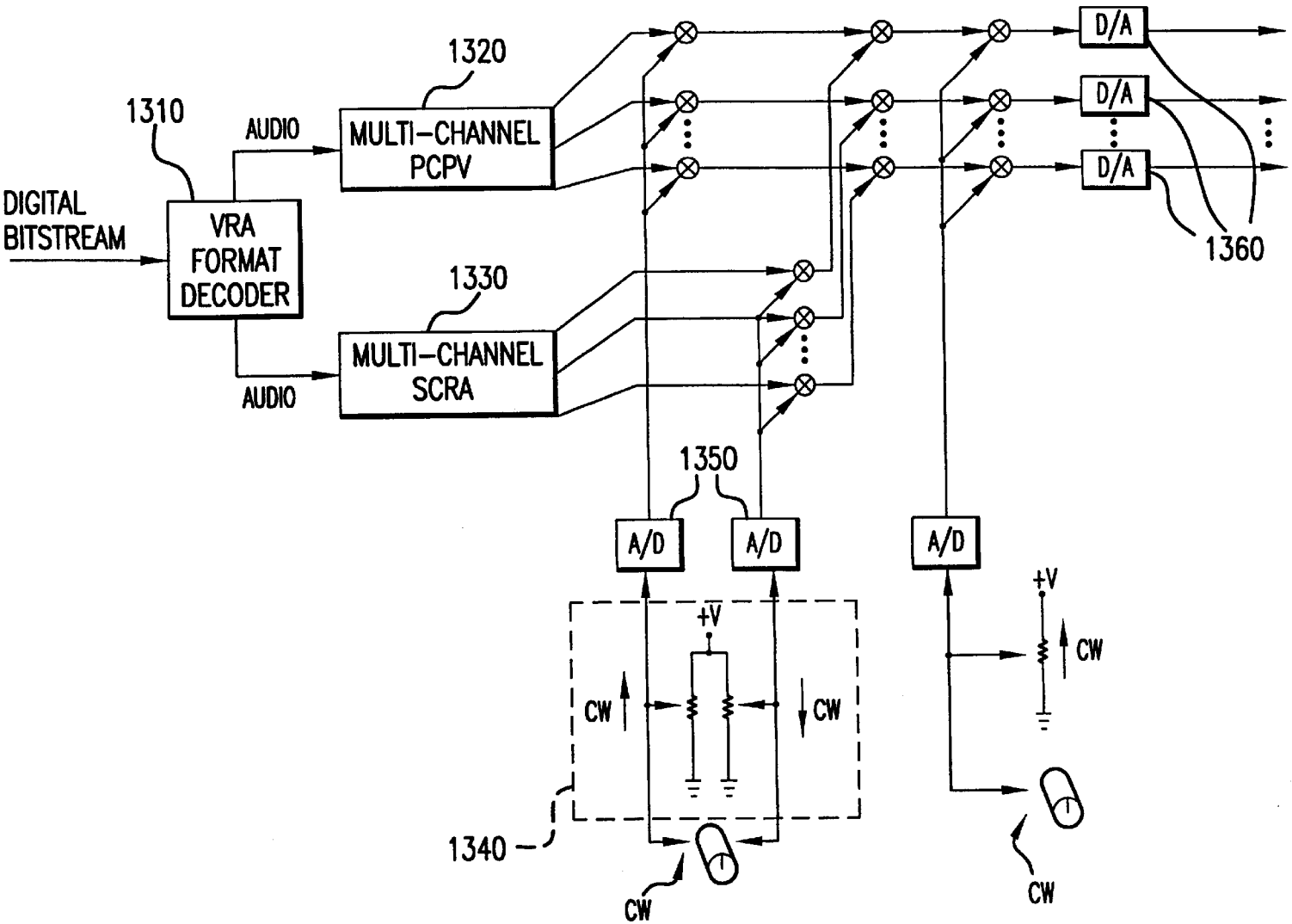
FIG. 13 is a diagram illustrating a VRA format decoder that receives the digital bitstream and decodes the signal into two audio parts.

FIG. 13 illustrates the VRA format decoder 1310 receiving the digital bitstream and decoding the signal into its two audio parts: the PCPV 1320 and SCRA 1330 signals. As noted earlier, each of these signals contains multiple channels that after end user adjustment, are added together to form the total program. The embodiment in the preceding paragraph discusses end user adjustment of each of those multiple channels.

Alternatively, the embodiment shown in FIG. 13 shows a single adjustment mechanism 1340 that will control the overall level of all PCPV channels and all SCRA channels, thereby effecting the desired VRA ratio. This is done in the digital domain by first using a balance style analog potentiometer to generate two voltages that represent the desired levels of the voice and remaining audio.

For example, when the knob is turned clockwise, the variable resistor (connected to the knob) on the left moves upward toward the supply voltage and away from signal ground. This causes the wiper voltage to increase. The analog to digital converter 1350 reads the voltage and assigns a digital value to it, which is then multiplied to all of the PCPV signals (regardless of how many have been decoded). Likewise, when the potentiometer is moved counter clockwise the variable resistor on the right moves toward the supply voltage (and away from ground) to yield an increase it the voltage on the wiper.

This voltage is converted to a digital value and multiplied to all of the decoded remaining audio (SCRA) signals. This arrangement using a single knob allows the user to simply and easily control the independent levels of the voice and the remaining audio thereby achieving the desired listening ratio. After multiplication, each of the PCPV channels is added to each of the SCRA (in a respective manner where the centers arre added, the lefts are added etc.) to form the total audio program in as many channels as have been decoded. Finally, a further level adjustment can be applied to the total audio signal in a similar fashion but by using only a single potentiometer (main volume control) before the adjusted total program audio is sent to the amplifier and speaker through the digital to analog converters 1360 for each spatial channel.

User Equalization Control—A more advanced feature that will provide further end user adjustment of the PCPV and SCRA signals is the ability to separately adjust the frequency weighting of the PCPV and SCRA signals. This may be useful for a person with a specific type of hearing impairment that attenuates high frequencies. Simple level adjustment of the PCPV(voice) signal may not provide the needed increase in intelligibility before the ear begins saturating at the lower frequencies. By allowing a frequency dependent adjustment (also known as equalization) of the PCPV signal improved intelligibility may be achieved for certain types of programming. In addition, very low frequency information in the SCRA signal (such as an explosion) may be obscuring the speech formats in the PCPV channel. Frequency dependent level control of the SCRA signal (independent from the PCPV signal) may retain critical mid-frequency audio components in the SCRA channel while improving speech intelligibility. Again, this can be performed in hardware that is separate from the decoding process as long as the PCPV and SCRA channel have been encoded and decoded using the VRA audio format, thus requiring no extra information to be transmitted in the auxiliary channel.

PCPV and SCRA Specific Metadata—There is a variety of metadata that was included in the encoder discussion that can be used to further enhance the playback features available with dual program audio (PCPV and SCRA). Unlike the level, spatial, and equalization adjustments discussed above, these features do require that encoded VRA auxiliary data be present in the metadata as part of the bitstream. These features include signal level, dynamic range compression, and normalization.

The signal level transmitted as part of the encoding process will provide data (at the decoding location) about the level of the PCPV and SCRA channels independently and as a function of time. This data can then be used to control the levels of the PCPV and SCRA channels independently and simultaneously in order to maintain the user selected VRA ratio in the presence of audio transients. For example, the signal level data of the SCRA channel may indicate that an explosion will overpower the PCPV (voice) during a certain segment, and by division, will indicate by how much.

Therefore, the decoding process can use that information with the playback hardware to automatically adjust the signal level of the SCRA by the appropriate amount so as to retain the user selected VRA ratio. This prevents the user from always adjusting the relative levels throughout the entire program.

Next, dynamic range information present in the bitstream will allow the user to select different playback ranges for both the PCPV and SCRA signals independently. The user selects the desired compression or expansion as a function of 100% of the full dynamic range and that is applied to each signal prior to their combination.

Finally, the normalization information, which is slightly different from the level information, provides a RMS or signal strength guage of both the PCPV and SCRA signals from program to program. This data may only be transmitted as part of the auxiliary data header file and will apply to the entire program. If the user chooses, this information can be used to normalize the PCPV signals across all programs as well as normalizing the levels of the SCRA signals across programs. This ensures that A) dialog (PCPV) heard from one program to the next will remain at a constant level (SPL) and B) explosions (SCRA) heard from one program to the next will remain at a constant level (SPL).

All of this functionality is only possible for the PCPV and SCRA signals when encoded using the VRA audio format. The same effects cannot be realized if they are applied to the production mix alone because the production mix contains the PCPV (voice) and SCRA (remaining audio) completely integrated and not separable.

Archival Embodiments

The embodiments described below are presented in order to illustrate the wide range of archival configurations that can be used to store the VRA information in such a way that the end-user will ultimately benefit from the VRA adjustment. The common theme of all the archival embodiments listed here is that each one represents a form of archived digital audio media that does not currently accommodate the storage of the PCPV/PCA signals and/or the SCRA signal and/or the VRA-header and/or the VRA-auxiliary data but all of the media listed have the potential for modification so that they can become VRA-capable archived digital audio media. For the archived media described below, the label of 'VRA-capable soundtrack' refers to a soundtrack that has the PCPV/PCA/SCRA signals stored as particular channels and/or has sufficient VRA-auxiliary data such that one or both of those signals can be constructed and played back using the VRA decoder features introduced earlier. Again, we note that the definition of such VRA-capable soundtracks is an invention in itself, and is underlied by the various embodiments that are required for implementation described earlier.

- CD with LPCM versions of the PCPV/PCA and SCRA signals stored as two separate tracks on the CD. Note that this embodiment will sacrifice the stereo positioning.
- CD with Optimized LPCM versions of the PCPV/PCA signal stored in addition to the conventional stereo signals found on CD media.
- DVD movies with DTS VRA-capable soundtrack.
- DVD movies with LPCM VRA-capable soundtrack.
- DVD movies with MLP VRA-capable soundtrack.
- DVD movies with MPEG-4 VRA-capable soundtrack.
- DVD movies with MPEG-2 VRA-capable soundtrack.
- DVD movies with Dolby Digital VRA-capable soundtrack.

DVD-audio discs with VRA-capable formatting.

SuperAudio CD with VRA-capable formatting.

Re-Authoring of Existing Audio Master Tapes for Production of VRA-Capable Versions One expected benefit of providing the VRA adjustment for movies or other audio programs with significant vocal content is the improvement of speech intelligibility by the listener. This will be particularly true for hearing impaired individuals. At this time, there are literally thousands of films that exist in analog formats versus digital formats. It is also true that none of these films were created to be VRA-capable. Therefore, there is a need for 're-authoring' of these non-VRA-capable, analog soundtracks so that the PCPV/PCA/SCRA signals are generated, along with the corresponding VRA-auxiliary data. That new information can then be stored in any of the VRA-capable digital master formats presented above. This invention will result in a wider range of VRA-capable films available to the hearing impaired community.

Video-on-Demand VRA-Capable Soundtrack Archives and Database

The advent of digital audio and streaming video/audio has enabled a new opportunity called 'video-on-demand'. Video-on-demand (VOD) systems allow a user to download a movie or other program of his/her choice via an ISDN line, or modem, for one-time playback on the user's digital television (or using an analog television with a set-top converter box). At this time, there are no films in the VOD data bases that have VRA-capable soundtracks. As the VRA adjustment hardware becomes integrated in future consumer electronics devices, VOD users will probably prefer to order the VRA-capable soundtracks. Therefore, these embodiments are concerned with meeting that expected need. The first invention is a VOD database that includes of films that have VRA-capable soundtracks. These VRA-capable videos can then be downloaded by hearing impaired listeners, or other viewers who enjoy using the VRA adjustment.

Another related aspect of the invention is the creation of a new archive of audio soundtracks, without the corresponding video information, where the new archive consists of VRA-capable soundtrack audio only. Archival of the audio-only portion for a VRA-capable movie will provide a huge savings in storage requirements for the VOD database. The VRA-capable soundtracks (without video) will be created in the same manner as discussed earlier for embodiments that enable the VRA-capable systems, in addition to one other feature. These VRA-capable soundtracks will be time synchronized to the audio content of the original motion picture or program using cross-correlation signal processing techniques and/or time synchronization methods if the non-VRA-capable soundtrack has time marks available. Both methods will serve to correlate the VRA-capable audio information with the non-VRA-capable audio information that resides on the original film. After the correlation is optimized, the film can be played with the original soundtrack muted and the VRA-capable soundtrack on.

MP3 VRA-Capable Music Archives

The use of MPEG-2 Layer III (MP3) has become very popular for music recordings that are streamed from an archived database to some internet media playback device. The previous definitions of system components that enable VRA-capable digital audio files apply equally well to MP3 formats. Therefore, this invention is concerned with the creation of VRA-capable MP3 recordings that reside in a special data base for downloading by a listener (commercially or otherwise).

Figure 14:
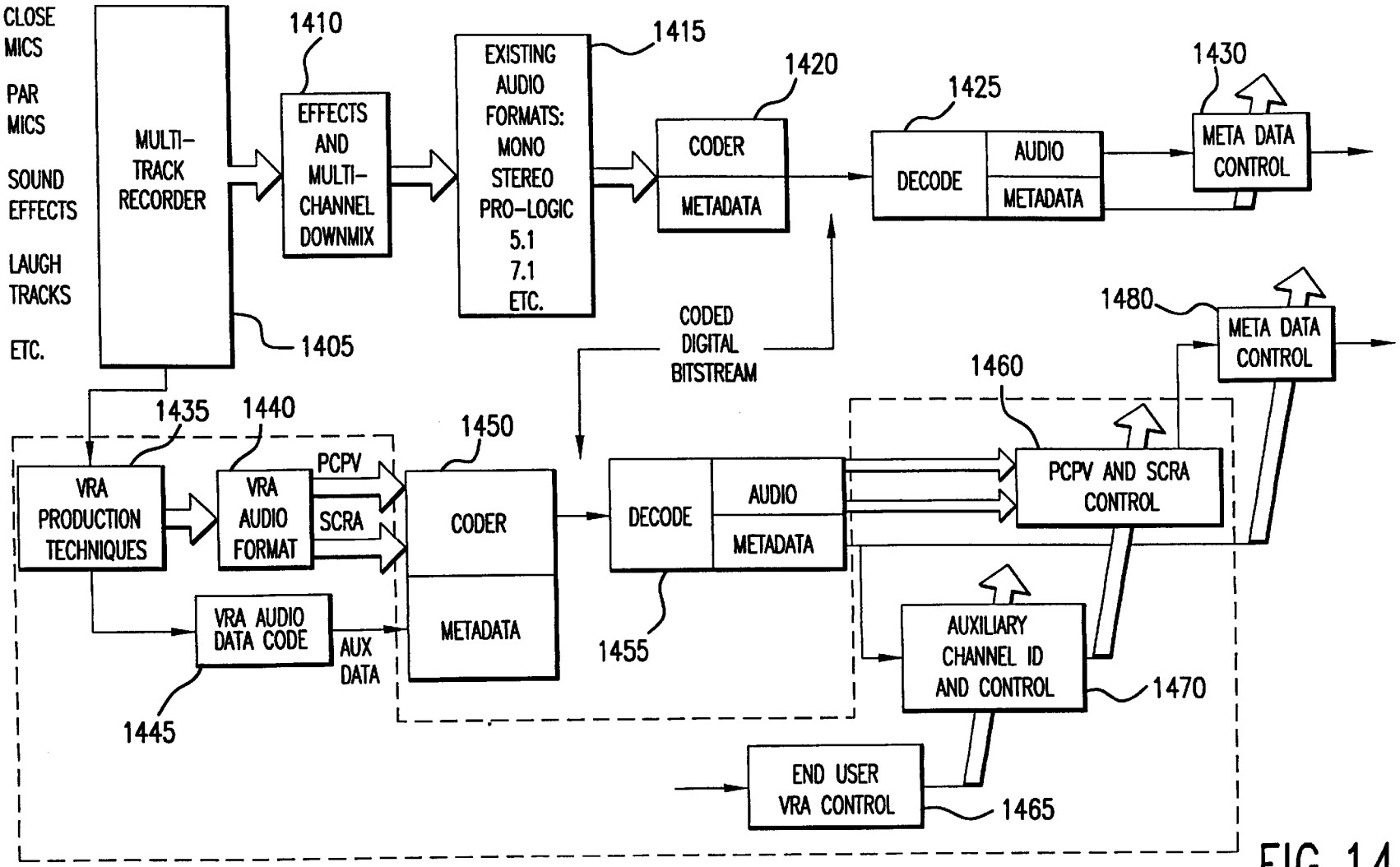
FIG. 14 is a diagram of an exemplary audio signal processing system of the invention.

In FIG. 14, the upper segments of the block diagram show the current state of the art to deliver audio programming from producer to user. During pre- and post-production, a variety of audio segments are available to the engineer in a multi-track recorded format 1405 that may include close microphone recordings, far microphone sounds, sound effects, laugh tracks, and any other possible sounds that may go into forming the entire audio program. The sound engineer then takes each of these components adds, effects, spatially locates and/or combines the sound components in order to conform to an existing audio format 1415. These existing audio formats 1415 may include mono, stereo, Pro-Logic, 5.1, 7.1 or any other audio format that the engineer is conforming to.

Once the program has been produced in the desired format, it is passed into a coding scheme 1420 which may include metadata. Any number of coding schemes will be employed at this stage that may include uncompressed, lossless compression, or lossy compression techniques. Some common coding schemes include Dolby Digital, MPEG-2 Layer 3 (for audio), Meridian Lossless Packing, or DTS. The output of such a coder is a digital bitstream which is either broadcast or recorded for playback or broadcast. Upon reception of the digital bitstream, the decoder 1425 will generate audio and if used, metadata. Note that the combination of the coder 1420 and the decoder 1425 is often referred to in the literature and in this document as the CODEC (i.e. coder-decoder). The metadata 1430 is considered to be data about the audio data and may include such features as dynamic range information, the number of separate channels that are available, and the type of compression that is used on the audio data.

The lower portion of FIG. 14 represents the embodiments of the invention discussed herein. Beginning with the multi-track recording, VRA production techniques 1435 are utilized (conforming to the specifications disclosed herein) to form a new audio format that is distinctly different from all preceding ones. The VRA format itself has its own metadata shown in the figure as the VRA audio data code 1445.

In addition, preceding formats have focused on spatiality for generating audio channels from audio tracks, whereas this new format focuses on generating both CONTENT and SPATIAL channel from the master audio tracks at the production level. Among many other things, the desired production mix (driven by the sound engineer) of the content portions into spatial location at the playback site is retained and controlled by the creation of the auxiliary data stream via the VRA production techniques. At this point the auxiliary data, the PCPV (primary content pure voice) and SCRA (secondary content remaining audio) are used by any standard CODEC, similar to the conventional techniques. The CODEC 1450, 1455 makes no specification on the content and format of the audio and/or information contained in the metadata, but rather codes any data it receives and likewise decodes it at the reproduction location. Once the audio data (PCPV and SCRA) and auxiliary data (via CODEC metadata) are received and decoded, the end user controls the auxiliary channel identification 1470 and control data 1465 (if it is present and recognized) and the PCPV and SCRA channels are then controlled by those end user adjustments 1460. If present and required by the original CODEC, additional metadata can be used to further control the playback 1480 without affecting the performance of the VRA audio format and associated reproduction.

Although various embodiments are specifically illustrated and described herein, it will be appreciated that modifications and variations of the present invention are covered by the above teachings and within the purview of the appended claims without departing from the spirit and intended scope of the invention. In particular, invention may include:

A VRA-capable codec that: accepts a parallel input configuration of the PCPV/PCA signal(s) and the SCRA signal(s), compresses the PCPV/PCA signal(s) using any speech-only compression algorithm, compresses the SCRA signal(s) using any general audio compression algorithm, without loss of the original time-alignment and video-frame synchronization between the two audio signal and any accompanying video, multiplexes the two compressed bitstreams, along with corresponding associated data that defines the specific compression algorithms and syntaxing methods used for the signals, said multiplexed bitstream either stored as a VRA-capable file or transmitted to a corresponding demultiplexer that separates the PCPV/PCA and SCRA signals, routes them to the appropriate decompression algorithms and then sends the two signals to a storage medium or to the appropriate volume control and playback devices that enable the VRA-adjustment for an end-listener.

A VRA codec that is independent of the specific voice-only compression and general audio compression algorithms used to compress the PCPV/PCA and SCRA signals.

A VRA-encoding process that recognizes the data header of a VRA-capable digital master or VRA-capable archived audio file and automatically proceeds with the parallel compression of the PCPV/PCA and SCRA signals, using the voice-only compression and general audio compression.

Numerous available 'speech-only' compression and 'general audio' compression algorithms VRA-capable decoder that recognizes the incoming VRA-multiplexer associated data and acts to demultiplex and decompress the VRA bitstream into the separated PCPV and PCA signals.

A VRA-capable decoder that is programmed to toggle between conventional decoding software for multiple-channel playback and a VRA-playback mode where the PCPV/PCA and SCRA signals comprise the playback signals sent to the speakers attached to the playback device.

A VRA-capable decoder that utilizes VRA auxiliary data information to determine the appropriate spatio-temporal playback information for the PCPV/PCA and SCRA signals.

A VRA-capable decoder that recognizes the existence of the VRA auxiliary data by specifying the identification bit (on or off) to determine if the incoming audio is VRA-capable (or not).

A VRA-capable codec as described above where the PCPV/PCA and SCRA signals are encrypted after the audio compression step, and un-encrypted before the decompression step.

A VRA-capable codec that utilizes VRA auxiliary data and/or auxiliary data channel, said VRA auxililary data created in such a manner as to identify the codec as VRA-capable through a specific bit pattern in the auxiliary data; identify the number of PCPV/PCA and SCRA channels that are to be used in a spatial audio playback configuration, said spatial playback for multiple channels being changeable at varying locations in the auxiliary data to indicate different spatial playback at different timings of the audio program; identify the production mix data so as to facilitate the VRA playback and volume adjustment process by the end-listener; include PCPV/PCA and SCRA specific metadata.

The VRA auxiliary data may be introduced as part of the metadata in any other codec, without loss of specificity of the purpose for the VRA auxiliary data defined here.

The creation of VRA auxiliary data that is compatible with the specific compression algorithms used in conjunction with the VRA-capable codec.

The use of VRA auxiliary data in conjunction with the AC3 television audio format in order to enable multiple channel and/or spatially distributed playback of the PCPV signal(s) and multiple channel and/or spatially distributed playback of the SCRA signal(s).

Re-authoring of existing film, movie, and television soundtracks' audio master tapes to create VRA-capable versions of the soundtracks.

VRA-capable means PCPV signal resides as separate audio information in the soundtrack storage medium.

VRA-capable means SCRA signal resides as separate audio information in the soundtrack storage medium.

Re-authoring means to combine some artistic combination of one or more vocal tracks existing on the original soundtrack audio master tape in such a way as to create the primary content pure voice track for subsequent adjustment by a VRA-capable playback device.

Re-authoring means to combine some artistic combination of one or more non-vocal tracks existing on the original soundtrack audio master tape in such a way as to create the secondary content remaining audio track for subsequent adjustment by a VRA-capable playback device.

Re-authoring means to take the newly created PCPV and SCRA information and construct a VRA-capable digital master audio storage medium as disclosed in the archiving claims.

Creation of a digital database, or archiving system, consisting of VRA-capable film soundtracks for the purposes of transmitting VRA-capable movies, films, or television programs via satellite, internet, or other digital transmission means to VRA-capable playback devices.

Digital databases to include video-on-demand film, movie, web-tv, digital television, or other programs.

Digital database may consist of a single film entity where the corresponding soundtrack is VRA-capable, using means disclosed elsewhere in this document.

Digital database may consist of only the VRA-capable audio soundtrack, with appropriate time-synchronization and video-frame synchronization, so that the VRA-capable soundtrack can be sent independently of the original program soundtrack for substitution as the soundtrack of choice at the time of audio playback.

Creation of a digital database, or archiving system, consisting of VRA-capable music audio (e.g..WAV, .MP3, or others), said VRA-capable music audio created with some blend of vocal tracks designated as the primary content pure voice audio, and some blend of instruments designated as the secondary content remaining audio.

Digital database may consist of only the designated PCPV audio information, time-synchronized the original musical recording or digital file, to facilitate substitution of the PCPV vocals at the time of playback.

A recording medium contains or have recorded thereon, any of the features discussed herein.

What is claimed is:

1. An audio production method, comprising:

providing at least one track in a plurality of audio tracks, the one track comprising primary content pure voice (PCPV) audio, the plurality of audio tracks stored on a storage medium, and the plurality of audio tracks having a time-synchronization;

generating a PCPV signal from the at least one track;

compressing the PCPV signal using a digital compression format having a first compression ratio;

providing at least one other track in the plurality of audio tracks, the at least one other track comprising secondary content remaining audio (SCRA) audio;

generating an SCRA signal from the at least one other track;

compressing the SCRA signal using a digital compression format having a second compression ratio;

creating a voice-to-remaining-audio (VRA) auxiliary data channel, the VRA auxiliary data channel:

identifying a VRA-capable digital master as VRA-capable, and identifying playback parameters of the PCPV and SCRA signals;

digitally storing on the VRA-capable digital master:

the PCPV signal, the SCRA signal, and the VRA auxiliary data channel;

wherein the storing step maintains the time-synchronization.

2. The audio production method of claim 1, wherein the plurality of audio tracks are related to an audio program having at least a primary vocal content and a background content.

3. The audio production method of claim 2, wherein the PCPV signal comprises sufficient primary vocal content such that the plot of the audio program is conveyed to a listener by listening to the PCPV audio.

4. The audio production method of claim 2, wherein the SCRA signal comprises sufficient background content such that the artistic value of the audio program is enhanced by blending the SCRA signal with the PCPV signal.

5. The audio production method of claim 1, wherein the PCPV signal is one of a mono signal, a stereo signal, and a surround sound signal.

6. The audio production method of claim 5, wherein the surround sound signal is one of a 5.1 surround sound format and a 7.1 surround sound format.

7. The audio production method of claim 1, wherein the SCRA signal is one of a mono signal, a stereo signal, and a surround sound signal.

8. The audio production method of claim 7, wherein the surround sound signal is one of a 5.1 surround sound format and a 7.1 surround sound format.

9. The audio production method of claim 1, wherein the playback parameters include volume levels for each of the PCPV and the SCRA signals, with respect to each other, that enable automatic control of the volume level of each of the signals so that the SCRA signal does not substantially obscure the PCPV signal during playback.

10. The audio production method of claim 1, wherein the first compression ratio is a ratio of substantially less than 12:1.

11. The audio production method of claim 1, wherein the first compression ratio is a ratio of substantially less than 8:1.

12. The audio production method of claim 1, wherein the second compression ratio is a ratio of substantially less than 12:1.

13. The audio production method of claim 1, wherein the second compression ratio is a ratio of substantially less than 8:1.

14. The audio production method of claim 1, wherein a format for digitally storing a signal on the VRA-capable digital master is one of a zero-channel format, a one-channel premixed format, a one-channel postmixed format, a two-channel premixed format, and a two-channel postmixed format.

15. The audio production method of claim 1, wherein the other track is one of a music track and an effects track.

16. The audio production method of claim 1, further comprising independent adjustment of the PCPV and SCRA signal amplitude upon playback of the VRA-capable digital master.

17. The audio production method of claim 16, further comprising mixing of the independently-adjusted PCPV and SCRA signals for playback, wherein the mixed independently-adjusted PCPV and SCRA signals are coupled to an electroacoustic device.

18. The audio production method of claim 16, wherein playback of the PCPV signal, SCRA signal, and VRA auxiliary data channel occurs simultaneously.

19. The audio production method of claim 1, wherein the plurality of audio tracks further includes time-alignment and video frame synchronization with a video signal.

20. The audio production method of claim 19, wherein the storing step occurs without loss of the time alignment and video frame synchronization between the PCPV signal, the SCRA signal, and the video signal.

21. The audio production method of claim 1, wherein the VRA-capable digital master stores audio programming for one of broadcast television, webcasting, streaming audio, compact disc (CD) audio, digital video disc (DVD) audio, motion picture audio, and video tape audio.

22. A codec for coding and decoding an audio program having at least a primary vocal content audio signal and a background content audio signal and any accompanying video signal, having time-alignment and video-frame synchronization between the primary vocal content audio signal, the background content audio signal, and any accompanying video signal, comprising:

a speech-only compressor that generates a first compressed audio signal from the primary vocal content audio signal;

a general audio compressor that generates a second compressed audio signal from the background content audio signal, the speech-only compressor and general audio compressor being arranged to separately accept the primary vocal content audio signal and the background content audio signal in a parallel input configuration, wherein the speech-only and general audio compressors compress the primary vocal content and background content audio signals without loss of the time-alignment and video-frame synchronization between the primary vocal content and background content audio signals and any accompanying video; and a multiplexer that generates a multiplexed bitstream of the first and second compressed audio signals and associated data, the associated data indicating at least an amount of speech-only and general audio compression and a bitstream syntaxing method used in generating the first and second compressed signals.

23. The codec of claim 22, further comprising:

a demultiplexer that demultiplexes the multiplexed bitstream to obtain the first and the second compressed audio signals; and a decoder that decodes the first and the second compressed audio signals to the first and second audio signals.

24. The codec of claim 23, further comprising transmitting the first and second audio signals to a volume control and playback device, the device enabling the independent volume adjustment of the first and second audio signals.

* * * * *

UNITED STATES PATENT AND TRADEMARK OFFICE

CERTIFICATE OF CORRECTION

PATENT NO. : 6,351,733 B1
DATED : February 26, 2002
INVENTOR(S) : Saunders et al.

It is certified that error appears in the above-identified patent and that said Letters Patent is hereby corrected as shown below:

Column 4,
Line 54, change “end listener” to -- end-listener --;

Column 6,
Line 28, change “the enabling” to -- enabling --;

Column 12,
Line 38, change “that has” to -- there has --;

Column 17,
Line 21, change “{” to -- ( --;

Column 19,
Line 55, change “liscense” to -- license --;

Column 20,
Line 27, change “embodiements” to -- embodiments --;

Column 21,
Line 27, delete “bulleted”;

Column 24,
Line 50, change “underlied” to -- underlain --; and

Column 27,
Line 10, change “invention may” to -- the invention may --.

Signed and Sealed this

Eighth Day of October, 2002

*Attest:*

*Attesting Officer*

JAMES E. ROGAN
*Director of the United States Patent and Trademark Office*